US009915107B1

(12) United States Patent
Schultz et al.

(10) Patent No.: US 9,915,107 B1
(45) **Date of Patent: *Mar. 13, 2018**

(54) VORTEX CONTROLLED VARIABLE FLOW RESISTANCE DEVICE AND RELATED TOOLS AND METHODS

(71) Applicant: Thru Tubing Solutions, Inc., Oklahoma City, OK (US)

(72) Inventors: Roger L. Schultz, Ninnekah, OK (US); Andrew M. Ferguson, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/060,269

(22) Filed: Mar. 3, 2016

Related U.S. Application Data

(63) Continuation of application No. 14/823,625, filed on Aug. 11, 2015, now Pat. No. 9,316,065.

(51) Int. Cl.

| | |
|---|---|
| ***E21B 7/24*** | (2006.01) |
| ***E21B 17/10*** | (2006.01) |
| ***F15C 1/16*** | (2006.01) |
| ***F15B 21/12*** | (2006.01) |
| ***E21B 34/06*** | (2006.01) |

(Continued)

(52) U.S. Cl.
CPC ..... *E21B 17/10* (2013.01); *E21B 7/24* (2013.01); *E21B 31/005* (2013.01); *E21B 34/06* (2013.01); *F15B 21/12* (2013.01); *F15D 1/0015* (2013.01); *Y10T 137/2234* (2015.04); *Y10T 137/2251* (2015.04)

(58) Field of Classification Search
CPC .. E21B 7/24; E21B 31/005; F15C 1/16; F15B 21/12; F15D 1/0015; Y10T 137/2234; Y10T 137/2264; Y10T 137/2251; Y10T 137/2229
See application file for complete search history.

(56) References Cited

U.S. PATENT DOCUMENTS 9,316,065 B1 * 4/2016 Schultz ..... E21B 17/20
2011/0042091 A1 2/2011 Dykstra et al.
(Continued)

OTHER PUBLICATIONS

European Patent Office, International Search Report & Written Opinion dated Oct. 19, 2016 in International Application No. PCT/IB2016/054461 entitled "Vortex Controlled Variable Flow Resistance Deice and Related Tools and Methods."

*Primary Examiner* — Giovanna C. Wright
(74) *Attorney, Agent, or Firm* — Mary M. Lee

(57) ABSTRACT

A vortex-controlled variable flow resistance device ideal for use in a backpressure tool for advancing drill string in extended reach downhole operations. The characteristics of the pressure waves generated by the device are controlled by the growth and decay of vortices in the vortex chamber(s) of a flow path. The flow path is designed to produce alternating primary and secondary vortices—one clockwise and one counter-clockwise—where the primary vortex is stronger and produces higher backpressure than the secondary vortex. This in turn generates alternating weak and strong pressure pulses in the drill string. The weak pulses may be barely perceptible so that the effective frequency of the pulses is determined by the stronger primary vortices.

12 Claims, 41 Drawing Sheets

(51) Int. Cl.
*E21B 31/00* (2006.01)
*F15D 1/00* (2006.01)

(56) References Cited

U.S. PATENT DOCUMENTS

2012/0292015 A1 11/2012 Schultz et al.
2014/0196905 A1 7/2014 Schultz et al.

* cited by examiner

| | |
|---|---|
| 1<br>Flow mostly exiting first vortex center. High flow, or low flow resistance. | |
| 2<br>First vortex forming, flow mostly exiting second vortex center. | |
| 3<br>Second vortex forming, flow mostly exiting third vortex center. | |
| 4<br>Third vortex forming, flow mostly exiting forth vortex center. | |
| 5<br>All vortex' forming and/or growing in strength. | |
| 6<br>All vortex' strengthening. Flow resistance increasing. | |

FIG. 34A

| | |
|---|---|
| 7<br>All vortex' strengthening. Flow resistance increasing | 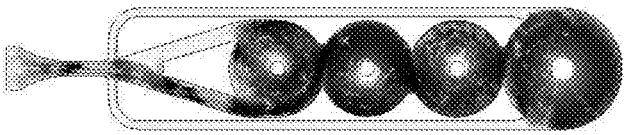 |
| 8<br>All vortex' strengthening. Flow resistance increasing. Jet switching. Flow resistance high. | 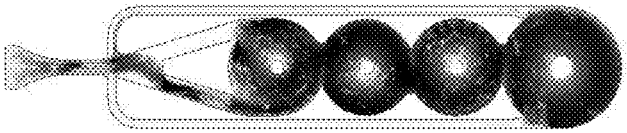 |
| 9<br>High flow resistance, jet continuing to switch. | 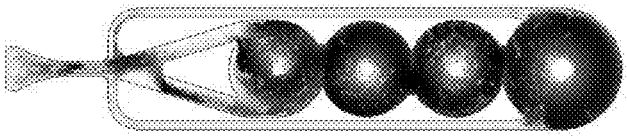 |
| 10<br>Vortex' weakening. Jet has switched. Flow in first vortex starting to reverse. Increasing flow into first vortex center. | 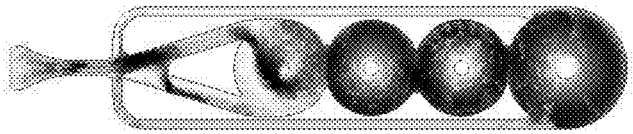 |
| 11<br>First vortex has collapsed. High flow into first vortex center. | 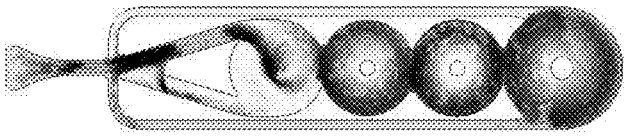 |
| 12<br>High flow into first vortex center, flow reversal starting in other vortex chambers. Process reversing. | 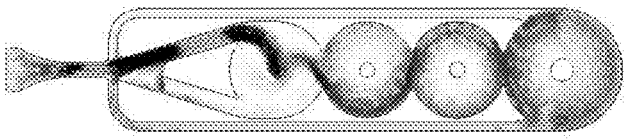 |

FIG. 34B

| | |
|---|---|
| 1<br>No vortex, low back pressure,<br>flow enters straight input channel, exits center | |
| 2<br>Fluid starts to rotate, back pressure increasing | |
| 3<br>Primary counter-clockwise vortex building, back pressure increasing | |
| 4<br>Strongest primary vortex, peak back pressure, fluid diverting to first feedback channel | |
| 5<br>Strong vortex, back pressure decreasing, feedback switches flow to bent input channel | |
| 6<br>Strong vortex, back pressure decreasing, radial flow from bent input channel enters vortex | |

FIG. 64A

| | |
|---|---|
| 7<br>Strong vortex, radial input begins to disrupt primary vortex, back pressure decreasing | 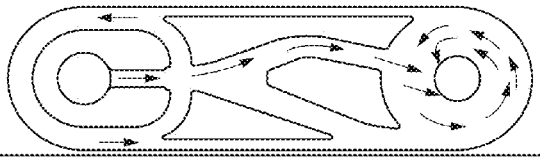 |
| 8<br>Primary vortex decayed; flow exits center; back pressure decreasing | 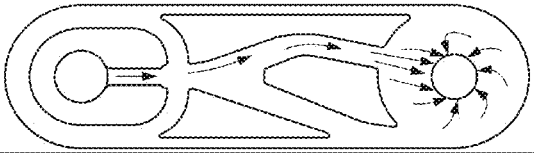 |
| 9<br>No vortex, very low back pressure, flow from bent input channel, exits center | 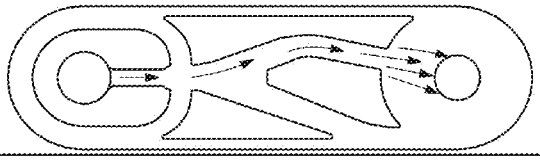 |
| 10<br>Fluid starts to rotate clockwise, back pressure slightly increasing | 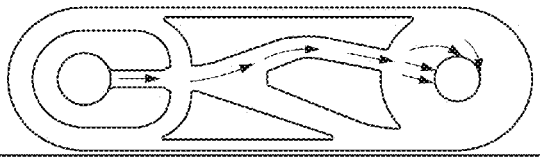 |
| 11<br>Secondary clockwise vortex slowly building, back pressure increasing | 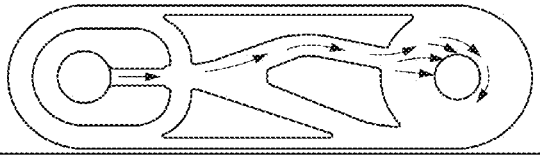 |
| 12<br>Secondary vortex building, back pressure increasing | 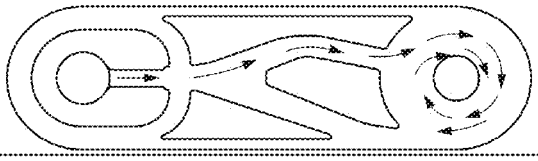 |

FIG. 64B

| | |
|---|---|
| 13<br>Peak secondary vortex, fluid diverting to second feedback channel | |
| 14<br>Strong secondary vortex, flow begins to switch | |
| 15<br>Secondary vortex weakening, input flow divided | |
| 16<br>Secondary vortex dissolved; back pressure decreasing | |
| 17<br>No vortex, lowest back pressure, flow enters straight input channel, exits center | |

FIG. 64C

| | |
|---|---|
| 1<br>No vortices, low back pressure,<br>flow enters straight input channels, exits centers | 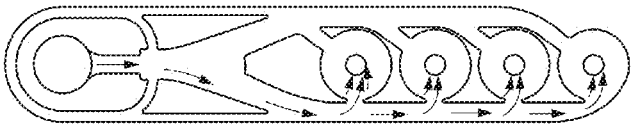 |
| 2<br>Fluid starts to rotate, back pressure increasing | 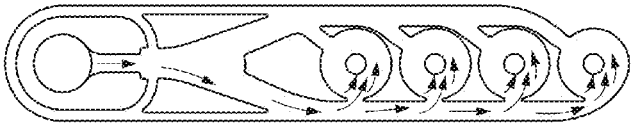 |
| 3<br>Primary counter-clockwise vortices building, back pressure increasing | 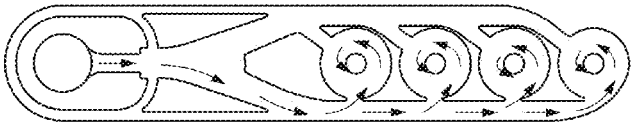 |
| 4<br>Strongest primary vortices, peak back pressure, fluid diverting to first feedback channel | 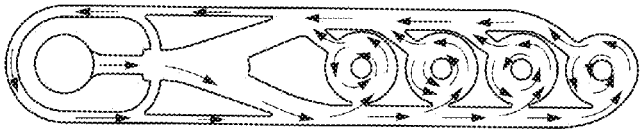 |
| 5<br>Strong vortices, back pressure decreasing, feedback switches flow to radial input channels | 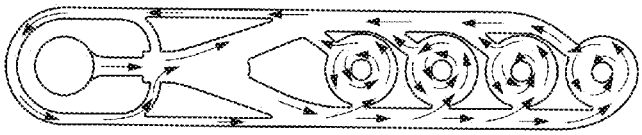 |

FIG. 67A

| | |
|---|---|
| 6<br>Strong vortices, back pressure decreasing, flow enters radial input channels | |
| 7<br>Strong vortices, radial input begins to disrupt primary vortices, back pressure decreasing | |
| 8<br>No vortices, very low back pressure, flow from radial input channels, exits center | |
| 9<br>Fluid starts to rotate clockwise, back pressure slightly increasing | |
| 10<br>Secondary clockwise vortices slowly building, back pressure increasing | |

FIG. 67B

| | |
|---|---|
| 11<br>Secondary vortices building, back pressure increasing | |
| 12<br>Peak secondary vortices, fluid diverting to second feedback channel | |
| 13<br>Secondary vortices weakening, input flow divided | |
| 14<br>Secondary vortices dissolved; back pressure decreasing | |
| 15<br>No vortices, lowest back pressure, flow enters straight input channel, exits centers | |

FIG. 67C

VORTEX CONTROLLED VARIABLE FLOW RESISTANCE DEVICE AND RELATED TOOLS AND METHODS

CROSS-REFERENCE TO RELATED APPLICATIONS

This application is a continuation of co-pending patent application Ser. No. 14/823,625, entitled "Vortex Controlled Variable Flow Resistance Device and Related Tools and Methods," filed Aug. 11, 2015, and the contents of this prior application are incorporated herein by reference.

FIELD OF THE INVENTION

The present invention relates generally to variable resistance devices and, more particularly but without limitation, to downhole tools and downhole operations employing such devices.

BRIEF DESCRIPTION OF THE DRAWINGS

FIGS. 34A and 34B are sequential schematic illustrations of fluid flow through the flow path illustrated in FIG. 32.

FIGS. 64A-64C are sequential schematic illustrations of fluid flow through the flow path illustrated in FIG. 57.

FIGS. 67A-67C are sequential schematic illustrations of fluid flow through the flow path illustrated in FIG. 65.

DETAILED DESCRIPTION OF THE PREFERRED EMBODIMENT(S)

Figure 1:
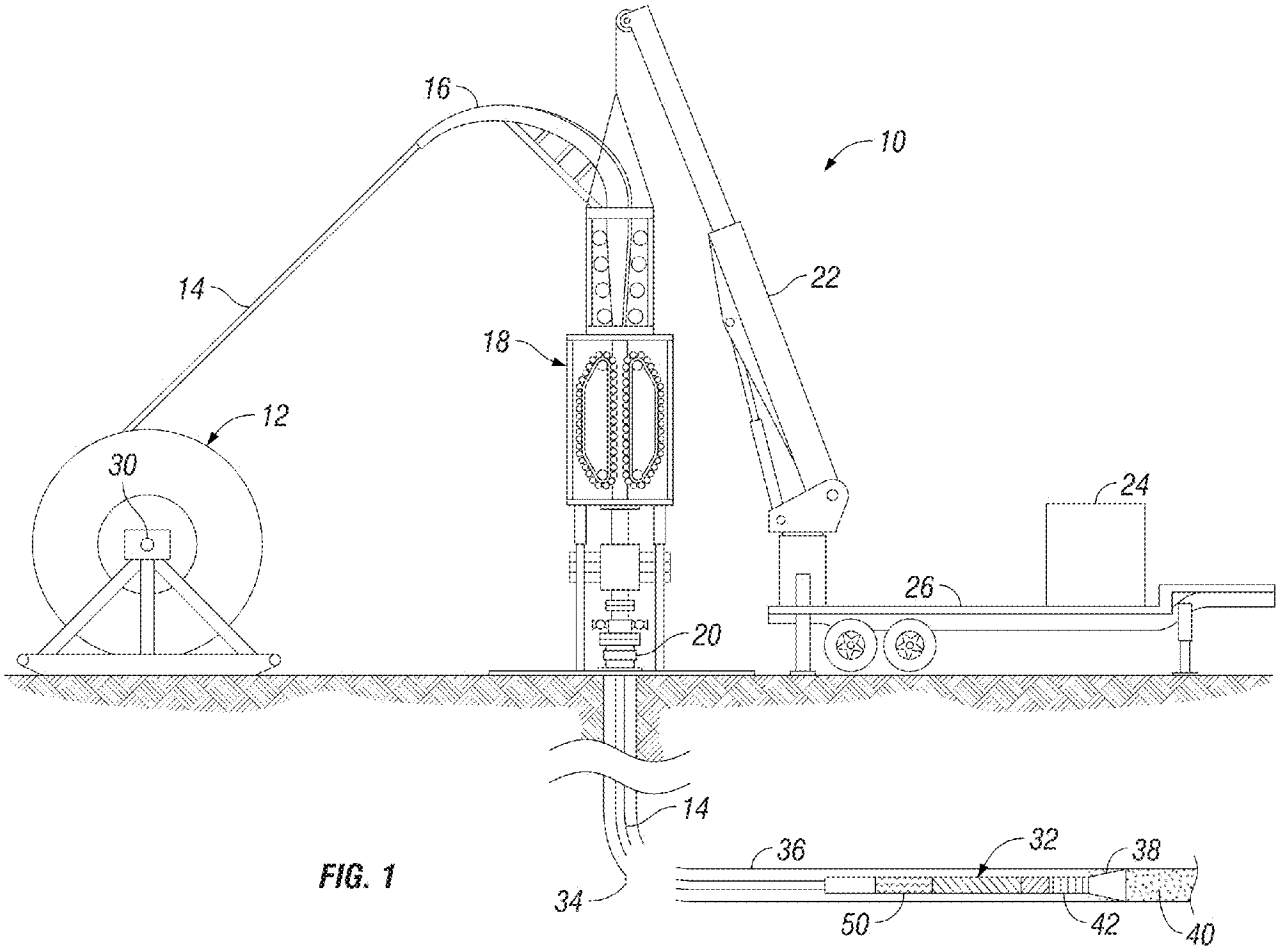
FIG. 1 is a diagrammatic illustration of a coiled tubing deployment system comprising a downhole tool incorporating a variable resistance device in accordance with the present invention.

Coiled tubing offers many advantages in modern drilling and completion operations. However, in deep wells, and especially in horizontal well operations, the frictional forces between the drill string and the borehole wall or casing while running the coiled tubing is problematic. These frictional forces are exacerbated by deviations in the wellbore, hydraulic loading against the wellbore, and, especially in horizontal wells, gravity acting on the drill string. Additionally, sand and other debris in the well and the condition of the casing may contribute to the frictional force experienced.

Even relatively low frictional forces can cause serious problems. For example, increased friction force or drag on the drill string, reduces weight of the drill string impacting the bit. This force is known as "weight-on-bit" or WOB. In general, the WOB force is achieved through both gravity and by forcibly pushing the tubing into the well with the surface injector. In horizontal wells, the gravitational force available for creating WOB is often negligible. This is because most of the drill string weight is positioned in the horizontal section of the well where the gravitational forces tend to load the drill string radially against the casing or wellbore instead of axially towards the obstruction being drilled out.

When the drill string is forcibly pushed into the wellbore, the flexible coiled tubing, drill pipe, or jointed tubing will buckle or helix, creating many contact points between the drill string and casing or wellbore wall. These contact points create frictional forces between the drill string and wellbore. All the frictional forces created by gravity and drill string buckling tend to reduce the ability to create WOB, which impedes the drilling process. In some cases, the drill string may even lockup, making it difficult or impossible to advance the BHA further into the wellbore.

Various technologies are used to alleviate the problems caused by frictional forces in coiled tubing operations. These include the use of vibratory tools, jarring tools, anti-friction chemicals, and glass beads. For example, rotary valve pulse tools utilize a windowed valve element driven by a mud motor to intermittently disrupt flow, repeatedly creating and releasing backpressure above the tool. These tools are effective but are lengthy, sensitive to high temperatures and certain chemicals, and expensive to repair.

Some anti-friction tools employ a combination of sliding mass/valve/spring components that oscillate in response to flow through the tool. This action creates mechanical hammering and/or flow interruption. These tools are mechanically simple and relatively inexpensive, but often have a narrow operating range and may not be as effective at interrupting flow.

Tools that interrupt flow generate cyclic hydraulic loading on the drill string, thereby causing repeated extension and contraction of the tubing. This causes the drag force on the tubing to fluctuate resulting in momentary reduction in the frictional resistance. The pulsating flow output from these tools at the bit end facilitates removal of cuttings and sand at the bit face and in the annulus. This pulsating flow at the end of the bottom hole assembly ("BHA") generates a cyclic reactionary jet force that enhances the effects of the backpressure fluctuations.

The present invention provides a variable flow resistance device comprising a fluidic oscillator. Fluidic oscillators have been used in pulsing tools for scale removal and post-perforation tunnel cleaning. These fluid oscillators use a specialized fluid path and the Coandă wall attachment effect to cause an internal fluid jet to flow alternately between two exit ports, creating fluid pulsation. The devices are compact and rugged. They have no moving parts, and have no temperature limitations. Still further, they have no elastomeric parts to react with well chemicals. However, conventional oscillators generate little if any backpressure because the flow interruption is small. Moreover, the operating frequency is very high and thus ineffective as a vibrating force.

The fluidic oscillation device of the present invention comprises a flow path that provides large, low frequency backpressures comparable to those generated by other types of backpressure tools, such as the rotary valve tools and spring/mass tools discussed above. The flow path includes a vortex chamber and a feedback control circuit to slow the frequency of the pressure waves, while at the same time minimizing the duty cycle and maximizing the amplitude of the backpressure wave. This device is especially suited for use in a downhole tool for creating cyclical backpressure in the drill string as well as pulsed fluid jets at the bit end. Although this variable flow resistance device is particularly useful as a backpressure device, it is not limited to this application.

A backpressure tool comprising the variable flow resistance device in accordance with the present invention is useful in a wide variety of downhole operations where friction negatively affects the advancement of the bottom hole assembly. By way of example, such operations include washing, cleaning, jetting, descaling, acidizing, and fishing. Thus, as used herein, "downhole operation" refers to any operation where a bottom hole assembly is advanced on the end of a drill string for any purpose and is not limited to operations where the BHA includes a bit or motor. As will become apparent, the device of the invention is particularly useful in drilling operations. "Drilling" is used herein in its broadest sense to denote excavating to extend an uncased borehole or to remove a plug or other obstruction in a well bore, or to drill through an obstruction in a well bore, cased or uncased.

A backpressure tool with the variable flow resistance device of this invention may have no moving parts. Even the switch that reverses the flow in the vortex chamber may be a fluidic switch. There are no elastomeric parts to deteriorate under harsh well conditions or degrade when exposed to nitrogen in the drilling fluid. Accordingly, the device and the downhole tool of this invention are durable, reliable, and relatively inexpensive to produce.

As indicated, the variable flow resistance device of the present invention is particularly useful in a downhole tool for creating backpressure to advance the drill string in horizontal and extended reach environments. Such backpressure tools may be used in the bottom hole assembly placed directly above the bit or higher in the BHA. Specifically, where the BHA includes a motor, the backpressure tool may be placed above or below the motor. Moreover, multiple backpressure tools can be used, spaced apart along the length of the drill string.

When constructed in accordance with the present invention, the backpressure device provides relatively slow backpressure waves when a flow at a constant flow rate is introduced. If the flow is introduced at a constant pressure, then a pulsed output will be generated at the downhole end of the tool. Typically, even when fluid is pumped at a constant flow rate, the tool will produce a combination of fluctuating backpressure and fluid pulses at the bit end. This is due to slight fluctuations in the flow supply, compressibility of the fluid, and elasticity in the drill string.

It will also be appreciated that a backpressure tool of this invention, when a retrievable insert or retrievable plug is utilized, will allow complete access through the tool body without withdrawing the drill string. This allows the unrestricted passage of wireline fishing tools, for example, to address a stuck bit or even retrieve expensive electronics from a unrecoverable bottom hole assembly. This reduces "lost in hole" charges.

Turning now to the drawings in general and to FIG. 1 in particular, there is shown therein a typical coiled tubing deployment system. Although the present invention is described in the context of a coiled tubing system, it is not so limited. Rather, this invention is equally useful with jointed tubing or drill pipe. Accordingly, as used herein, "drilling rig" means any system for supporting and advancing the drill string for any type of downhole operation. This includes coiled tubing deployment systems and derrick style rigs for drill pipe and jointed tubular drill string.

The exemplary coiled tubing drilling rig, is designated generally by the reference number 10. Typically, the drilling rig includes surface equipment and the drill string. The surface equipment typically includes a reel assembly 12 for dispensing the coiled tubing 14. Also included is an arched guide or "gooseneck" 16 that guides the tubing 14 into an injector assembly 18 supported over the wellhead 20 by a crane 22. The crane 22 as well as a power pack 24 may be supported on a trailer 26 or other suitable platform, such as a skid or the like. Fluid is introduced into the coiled tubing 14 through a system of pipes and couplings in the reel assembly, designated herein only schematically at 30. A control cabin, as well as other components not shown in FIG. 1, may also be included.

The combination of tools connected at the downhole end of the tubing 14 forms a bottom hole assembly 32 or "BHA." The BHA 32 and tubing 14 (or alternately drill pipe or jointed tubulars) in combination are referred to herein as the drill string 34. The drill string 34 extends down into the well bore 36, which may or may not be lined with casing (not shown). As used herein, "drill string" denotes the well conduit and the bottom hole assembly regardless of whether the bottom hole assembly comprises a bit or motor.

The BHA 32 may include a variety of tools including but not limited to bits, motors, hydraulic disconnects, swivels, jarring tools, backpressure valves, and connector tools. In the exemplary embodiment shown in FIG. 1, the BHA 32 includes a drill bit 38 for excavating the borehole through the formation or for drilling through a plug 40 installed in the wellbore 36. A mud motor 42 may be connected above the drill bit 38 for driving rotation of the bit. In accordance with the present invention, the BHA 32 further includes a backpressure tool comprising the variable flow resistance device of the present invention, to be described in more detail hereafter. The backpressure tool is designated generally at 50.

As indicated above, this particular combination of tools in the BHA shown in FIG. 1 is not limiting. For example, the BHA may or may not include a motor or a bit. Additionally, the BHA may comprise only one tool, such as the backpressure tool of the present invention. This might be the case, for example, where the downhole operation is the deployment of the drill string to deposit well treatment chemicals.

Figure 2:
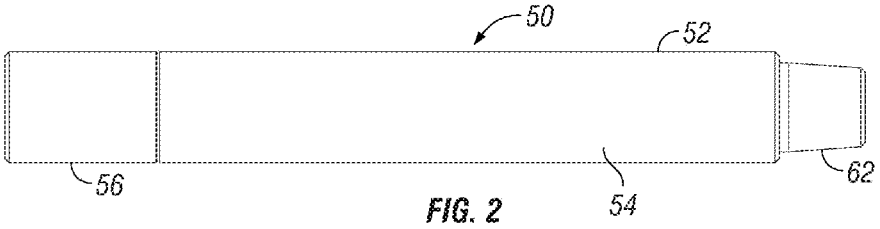
FIG. 2 is a side elevational view of a tool made in accordance with a first embodiment of the present invention.
Figure 3:
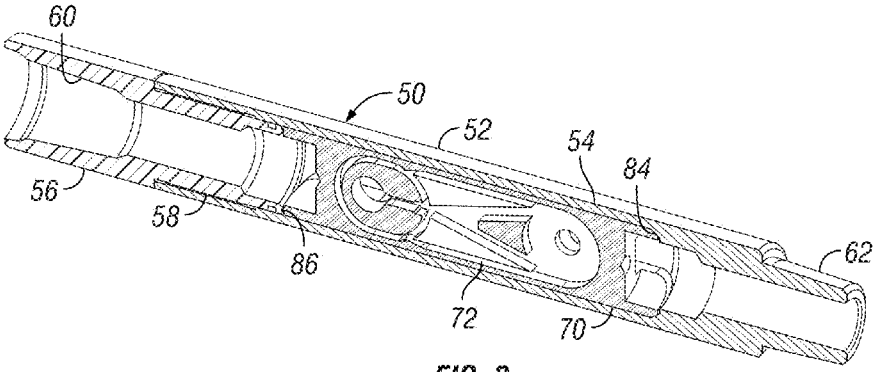
FIG. 3 is a perspective, sectional view of the tool of FIG. 2.
Figure 4:
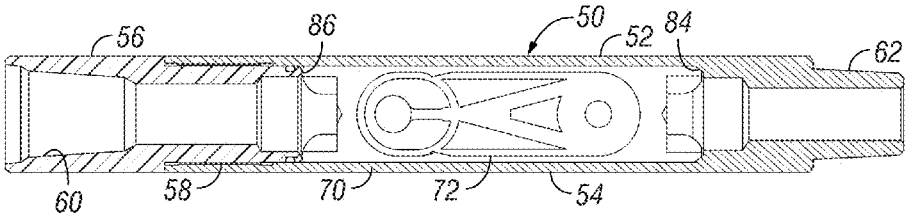
FIG. 4 is a longitudinal sectional view of the tool of FIG. 2.

With reference now to FIGS. 2-13, a first preferred embodiment of the backpressure pulse tool 50 will be described. As seen in FIGS. 2-4, the tool 50 preferably comprises a tubular tool housing 52, which may include a tool body 54 and a top sub 56 joined by a conventional threaded connection 58. The top sub 56 and the downhole end of the tool body 54 may be threaded for connection to other tools or components of the BHA 32. In the embodiment shown, the top sub has a box end 60 (internally threaded), and the downhole end of the body 54 is a pin end 62 (externally threaded).

Figure 5:
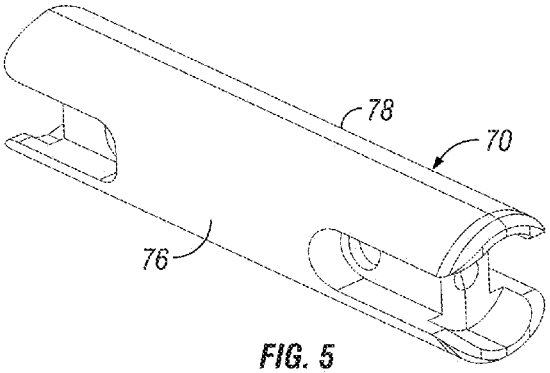
FIG. 5 is an enlarged perspective view of the fluidic insert of the tool of FIG. 2.
Figure 6:
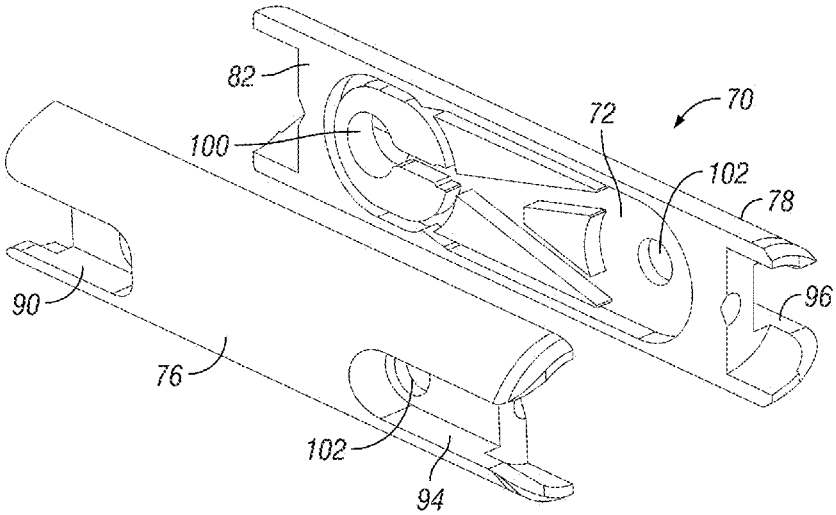
FIG. 6 is an exploded perspective view of the fluidic insert shown in FIG. 5.
Figure 7:
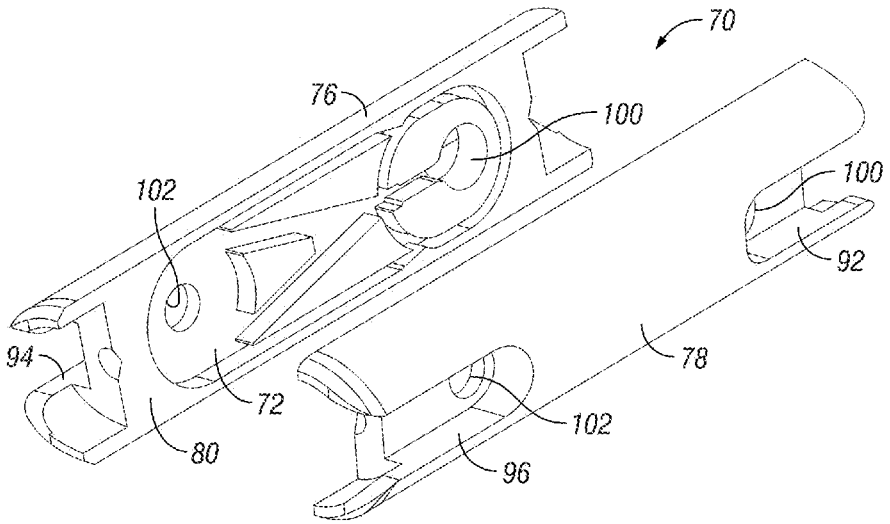
FIG. 7 is an exploded perspective view of the fluidic insert shown in FIG. 5, as seen from the opposite side.

The tool 50 further comprises a variable flow resistance device which in this embodiment takes the form of an insert 70 in which a flow path 72 is formed. Referring now also to FIGS. 5-7, the insert 70 preferably is made from a generally cylindrical structure, such as a solid cylinder of metal. The cylinder is cut in half longitudinally forming a first half 76 and a second half 78, and the flow path 72 is milled or otherwise cut into one or both of the opposing inner faces 80 (FIG. 7) and 82 (FIG. 6). More preferably, the flow path 72 is formed by two identically formed recesses, one in each of the opposing internal faces 80 and 82.

The cylindrical insert 70 is received inside the tool body 54. As best seen in FIGS. 3 and 4, a recess formed inside the tool body 54 captures the insert between a shoulder 84 at the lower end of the recess and the downhole end 86 of the top sub 56. Fluid entering the top sub 56 flows into the insert 70 through slots 90 and 92 in the uphole end of the insert and exits the insert through slots 94 and 96 in the downhole end.

As indicated above, in this embodiment, the flow paths formed in the faces 80 and 82 are mirror images of each other. Accordingly, the same reference numbers will be used to designate corresponding features in each. The slots 90 and 92 communicate with the inlets 100 of the flow path, and the outlet slots 94 and 96 communicate with the outlets 102.

The preferred flow path for the tool 50 will be described in more detail with reference to FIG. 8, to which attention now is directed. Fluid enters the flow path 72 through the inlet 100. Fluid is then directed to a vortex chamber 110 that is continuous with the outlet 102. In a known manner, fluid directed into the vortex chamber 110 tangentially will gradually form a vortex, either clockwise or counter-clockwise. As the vortex decays, the fluid exits the outlet 102.

A switch of some sort is used to reverse the direction of the vortex flow, and the vortex builds and decays again. As this process of building and decaying vortices repeats, and assuming a constant flow rate, the resistance to flow through the flow path varies and a fluctuating backpressure is created above the device.

In the present embodiment, the switch, designated generally at 112, takes the form of a Y-shaped bi-stable fluidic switch. To that end, the flow path 72 includes a nozzle 114 that directs fluid from the inlet 100 into a jet chamber 116. The jet chamber 116 expands and then divides into two diverging input channels, the first input channel 118 and the second input channel 120, which are the legs of the Y.

According to normal fluid dynamics, and specifically the "Coandă effect," the fluid stream exiting the nozzle 114 will tend to adhere to or follow one or the other of the outer walls of the chamber so the majority of the fluid passes into one or the other of the input channels 118 and 120. The flow will continue in this path until acted upon in some manner to shift to the other side of the jet chamber 116.

The ends of the input channels 118 and 120 connect to first and second inlet openings 124 and 126 in the periphery of the vortex chamber 110. The first and second inlet openings 124 and 126 are positioned to direct fluid in opposite, tangential paths into the vortex chamber. In this way, fluid entering the first inlet opening 124 produces a clockwise vortex indicated by the dashed line at "CW" in FIG. 8. Similarly, once shifted, fluid entering the second inlet opening 126 produces a counter-clockwise vortex indicated by the dotted line at "CCW."

Figure 8:
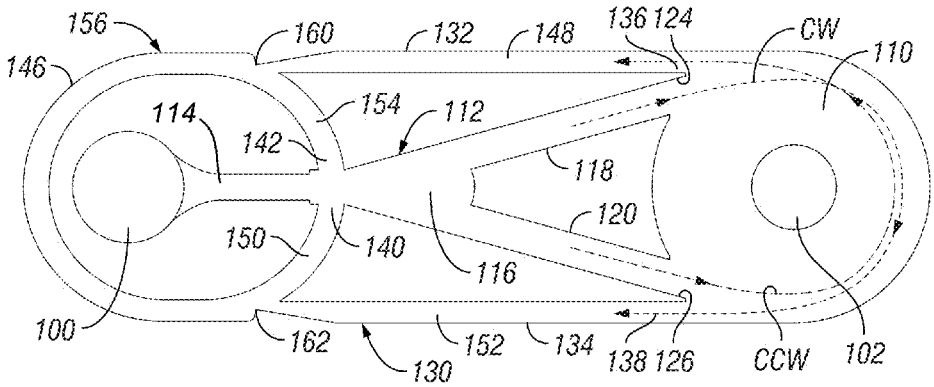
FIG. 8 is an enlarged schematic of the flow path of the tool shown in FIG. 2.

As seen in FIG. 8, each of the first and second input channels 118 and 120 defines a flow path straight from the jet chamber 116 to the continuous opening 124 and 126 in the vortex chamber 110. This straight path enhances the efficiency of flow into the vortex chamber 110, as no momentum change in the fluid in the channels 124 or 126 is required to achieve tangent flow into the vortex chamber 110. Additionally, this direct flow path reduces erosive effects of the device surface.

In accordance with the present invention, some fluid flow from the vortex chamber 110 is used to shift the fluid from the nozzle 114 from one side of the jet chamber 116 to the other. For this purpose, the flow path 72 preferably includes a feedback control circuit, designated herein generally by the reference numeral 130. In its preferred form, the feedback control circuit 130 includes first and second feedback channels 132 and 134 that conduct fluid to control ports in the jet chamber 116, as described in more detail below. The first feedback channel 132 extends from a first feedback outlet 136 at the periphery of the vortex chamber 110. The second feedback channel 134 extends from a second feedback outlet 138 also at the periphery of the vortex chamber 110.

The first and second feedback outlets 136 and 138 are positioned to direct fluid in opposite, tangential paths out of the vortex chamber 110. Thus, when fluid is moving in a clockwise vortex CW, some of the fluid will tend to exit through the second feedback outlet 138 into the second feedback channel 134. Likewise, when fluid is moving in a counter-clockwise vortex CCW, some of the fluid will tend to exit through the first feedback outlet 136 into the first feedback channel 132.

With continuing reference to FIG. 8 the first feedback channel 132 connects the first feedback outlet 136 to a first control port 140 in the jet chamber 116, and the second feedback channel 134 connects the second feedback outlet 138 to a second control port 142. Although each feedback channel could be isolated or separate from the other, in this preferred embodiment of the flow path, the feedback channels 132 and 134 share a common curved section 146 through which fluid flows bidirectionally.

The first feedback channel 132 has a separate straight section 148 that connects the first feedback outlet 136 to the curved section 146 and short connecting section 150 that connects the common curved section 146 to the control port 140, forming a generally J-shaped path. Similarly, the second feedback channel 134 has a separate straight section 152 that connects the second feedback outlet 138 to the common curved section 146 and short connection section 154 that connects the curved section to the second control port 142.

The curved section 146 of the feedback circuit 130 together with the connection section 150 and 154 form an oval return loop 156 extending between the first and second control ports 140 and 142. Alternately, two separate curved sections could be used, but the common bidirectional segment 146 promotes compactness of the overall design. It will also be noted that the diameter of the return loop 156 approximates that of the vortex chamber 110. This allows the feedback channels 132 and 134 to be straight, which facilitates flow therethrough. However, as is illustrated later, these dimensions may be varied.

As seen in FIG. 8, in this configuration of the feedback control circuit 130, the ends of the straight sections 148 and 152 of the first and second feedback channels 132 and 134 join the return loop at the junctions of the common curved section 146 and each of the connecting sections 150 and 154. It may prove advantageous to include a jet 160 and 162 at each of these locations as this will accelerate fluid flow as it enters the curved section 146.

It will be understood that the size, shape and location of the various openings and channels may vary. However, the configuration depicted in FIG. 8 is particularly advantageous. The first and second inlet openings 124 and 126 may be within about 60-90 degrees of each other. Additionally, the first inlet opening 124 is adjacent the first feedback outlet 136, and the second inlet opening 126 is adjacent the second feedback outlet 138. Even more preferably, the first and second inlet openings 124 and 126 and the first and second feedback outlets 136 and 138 are all within about a 180 degree segment of the peripheral wall of the vortex chamber 110.

Now it will be apparent that fluid flowing into the vortex chamber 110 from the first input channel 118 will form a clockwise CW vortex and as the vortex peaks in intensity, some of the fluid will shear off at the periphery of the chamber out of the second feedback outlet 138 into the second feedback channel 134, where it will pass through the return loop 156 into the second control port 142. This intersecting jet of fluid will cause the fluid exiting the nozzle 114 to shift to the other side of the jet chamber 116 and begin adhering to the opposite side. This causes the fluid to flow up the second input channel 120 entering the vortex chamber 110 in opposite, tangential direction forming a counter-clockwise CCW vortex.

As this vortex builds, some fluid will begin shearing off at the periphery through the first feedback outlet 136 and into the first feedback channel 132. As the fluid passes through the straight section 148 and around the return loop 156, it will enter the jet chamber 116 through the first control port 140 into the jet chamber, switching the flow to the opposite wall, that is, from the second input channel 120 back to the first input channel 118. This process repeats as long as an adequate flow rate is maintained.

Figure 9:
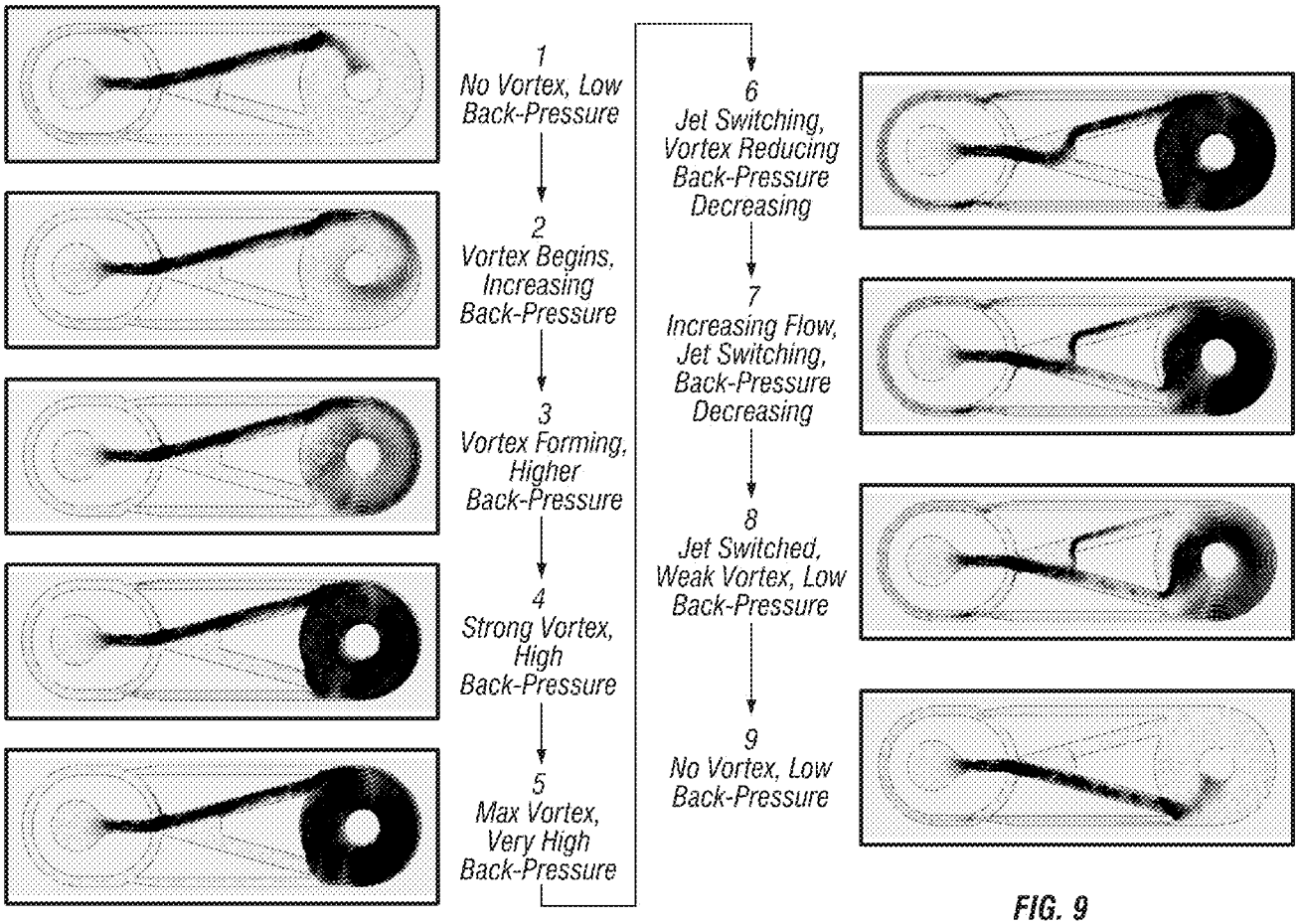
FIG. 9 is a sequential schematic illustration of fluid flow through the flow path illustrated in FIG. 8.

FIG. 9 is a sequential diagrammatic illustration of the cyclical flow pattern exhibited by the above-described flow path 70 under constant flow showing the backpressure modulation. In the first view, fluid is entering the inlet and flowing into the upper inlet channel. No vortex has yet formed, and there is minimal or low backpressure being generated.

In the second view, a clockwise vortex is beginning to form and backpressure is starting to rise. In the third view, the vortex is building and backpressure continues to increase. In view four, strong vortex is present with relatively high backpressure. In view five, the vortex has peaked and is generating the maximum backpressure. Fluid begins to shear off into the lower feedback channel.

In view six, the feedback flow is beginning to act on the jet of fluid exiting the nozzle, and flow starts to switch to the lower, second input channel. The vortex begins to decay and backpressure is beginning to decrease. In view seven, the jet of fluid is switching over to the other input channel and a counter flow is created in the vortex chamber causing it to decay further. In view eight, the clockwise vortex is nearly collapsed and backpressure is low. In view nine, the clockwise vortex is gone, resulting in the lowest backpressure as fluid flow into the vortex chamber through the lower, second input channel increases. At this point, the process repeats in reverse.

Figure 10:
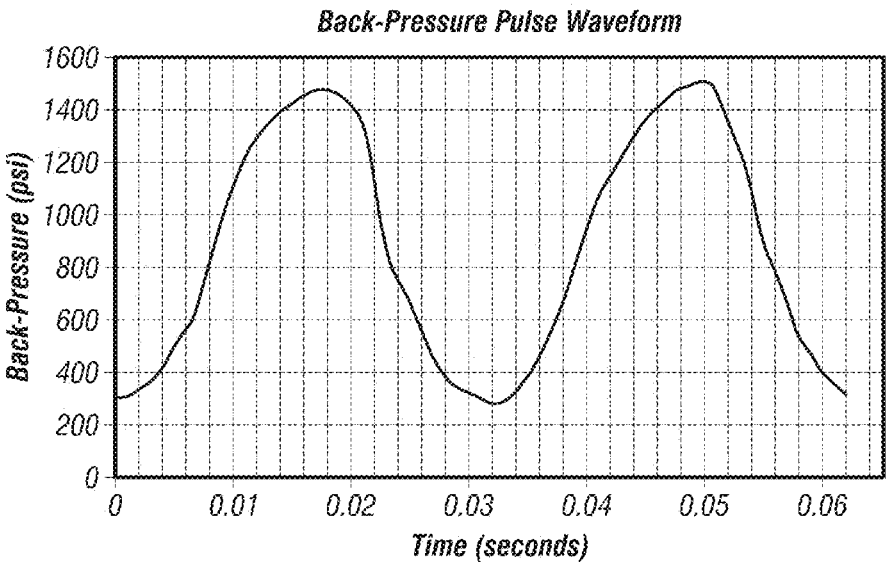
FIG. 10 is a CFD (computational fluid dynamic) generated back-pressure pulse waveform of a tool designed in accordance with the embodiment of FIG. 2.

FIG. 10 is a computational fluid dynamic ("CFD") generated graph depicting the waveform of the backpressure generated by the cyclic operation of the flow path 72. Backpressure in pounds per square inch ("psi") is plotted against time in seconds. This wave form is based on a constant forced flow rate of 2 barrels (bbl) per minute through a tool having an outside diameter of 2.88 inches and a makeup length of 19 inches. Hydrostatic pressure is presumed to be 1000 psi. The pulse magnitude is about 1400 psi, and pulse frequency is about 33 Hz. Thus, the flow path of FIG. 8 produces a desirably slow frequency and an effective amplitude.

Figure 11:
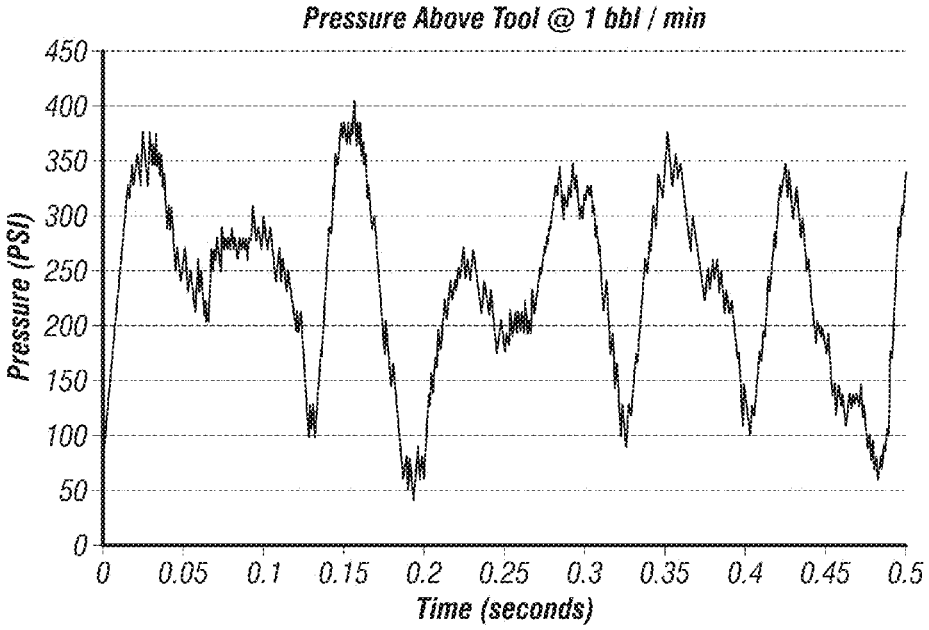
FIG. 11 is a pressure waveform based on data generated by a tool constructed in accordance with the embodiment of FIG. 2. This waveform was produced when the tool was operated at 1 barrel per minute.
Figure 12:
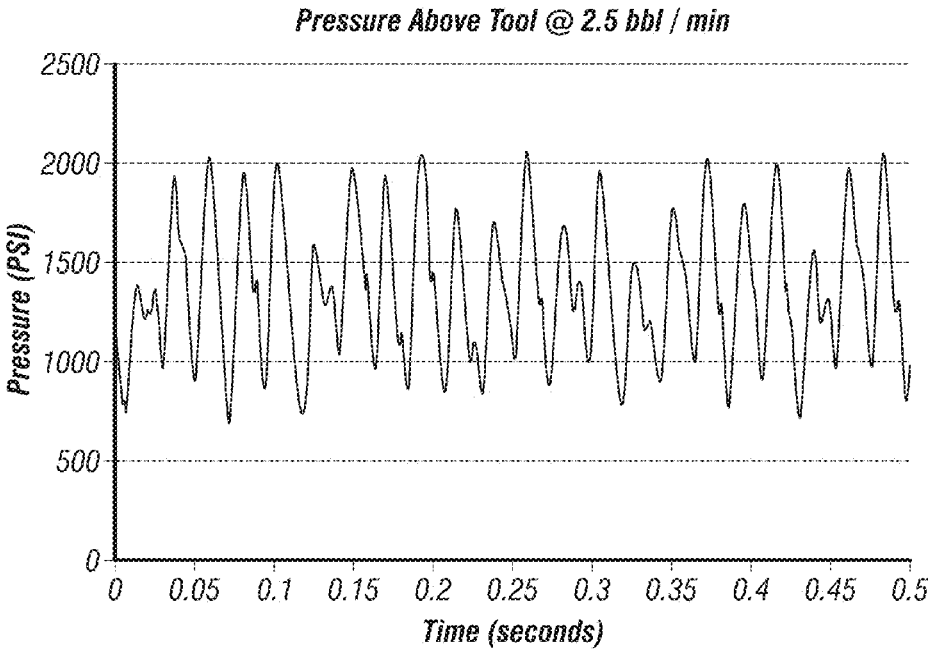
FIG. 12 is a pressure waveform of the tool of FIG. 2 when the tool was operated at 2.5 barrels per minute.
Figure 13:
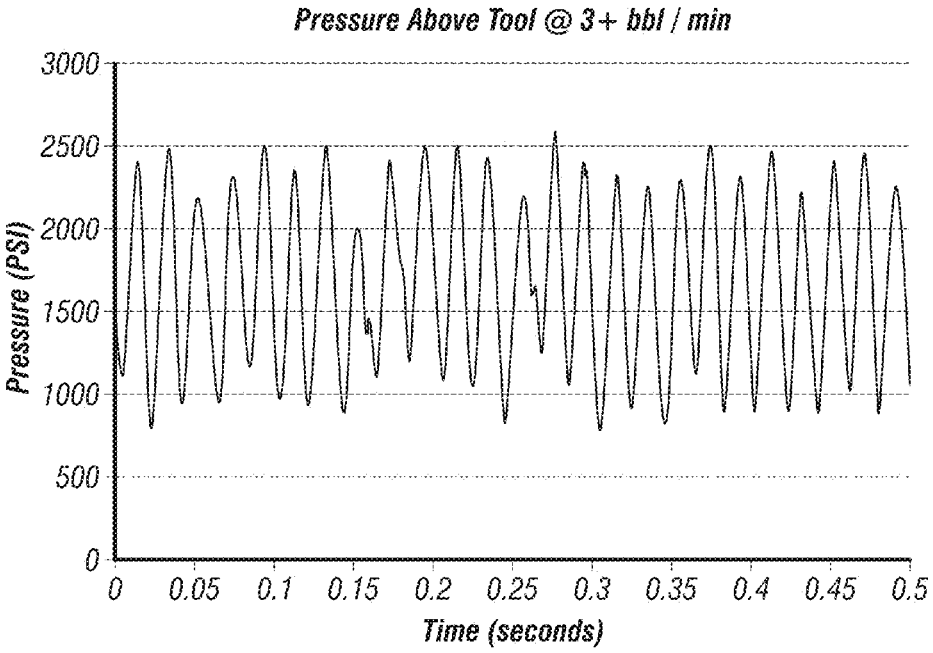
FIG. 13 is a graph of the pressure waveform of the tool of FIG. 2 when the tool was operated at greater than 3 barrels per minute.

FIGS. 11, 12, and 13 are waveforms generated by above-ground testing of a prototype made according to the specifications described above in connection with FIG. 10 at 1.0 bbl/min, 2.5 bbl/min and 3.0+ bbl/min, respectively. These graphs show the fluctuations in the pressure above the tool compared to the pressure below the tool. That is, the points on the graph represent the pressure differential measured by sensors at the inlet and outlet ends of the tool. These waveforms show cyclic backpressure generated by cyclic flow resistance which occurs when constant flow is introduced into the device.

As shown and described herein, the insert 70 of the tool 50 of FIGS. 2-8 is permanently installed inside the housing 52. In some applications, it may be desirable to have a tool where the insert is removable without withdrawing the drill string. FIGS. 14-17 illustrate such a tool.

Figure 14:
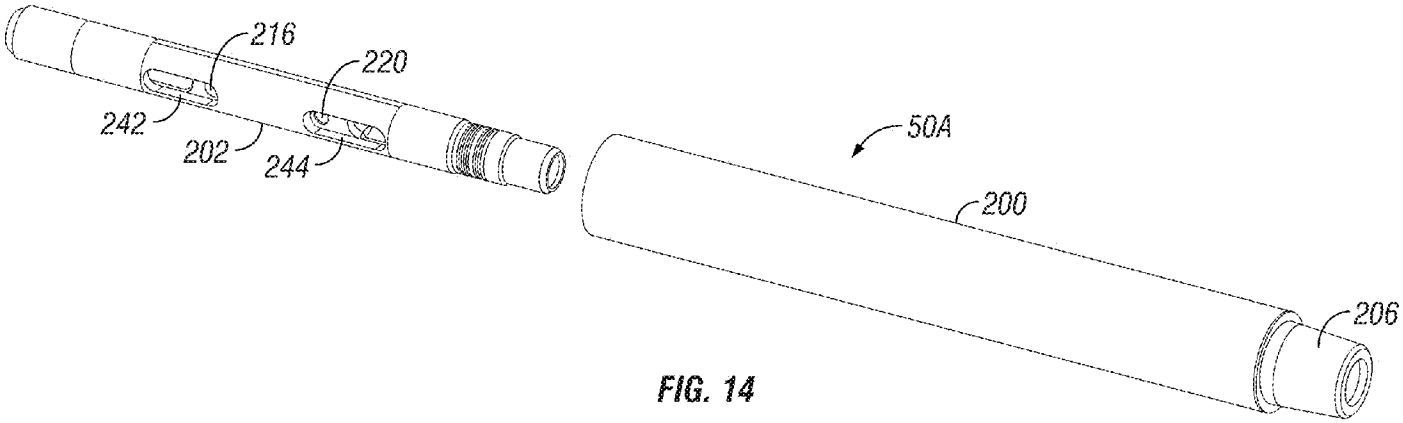
FIG. 14 is an exploded perspective view of a tool constructed in accordance with a second preferred embodiment of the present invention in which the backpressure device is a removable insert inside a tool housing.
Figure 15:
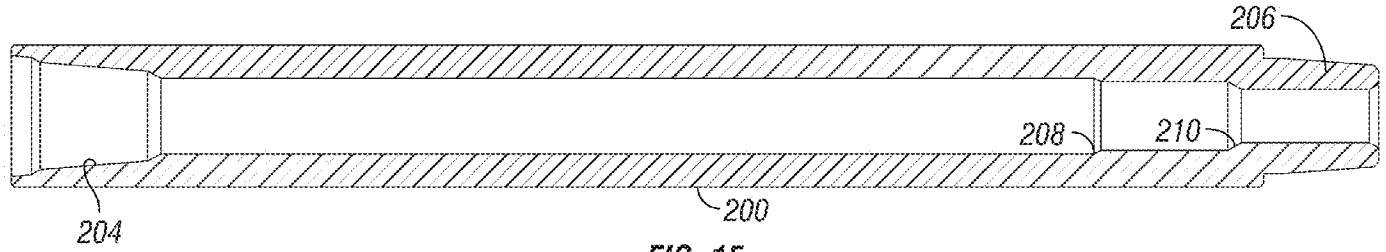
FIG. 15 is a longitudinal sectional view of the empty housing of the tool shown in FIG. 14.
Figure 16:
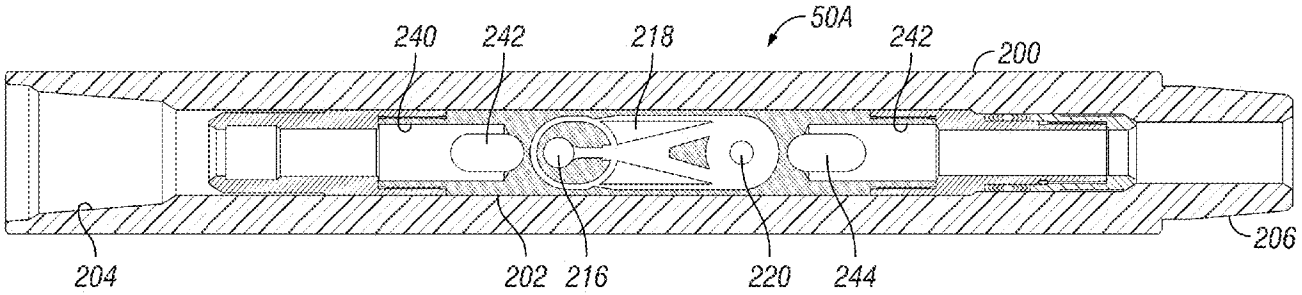
FIG. 16 is a longitudinal sectional view of the tool shown in FIG. 14 illustrating the insert inside the tool housing.

The tool 50A is similar to the tool 50 except that the insert is removable. As shown in FIG. 14, the tool 50A comprises a tubular housing 200 and a removable or retrievable insert 202. The tubular housing 200, shown best in FIG. 15, has a box joint 204 at the upper or uphole end and a pin joint 206 at the lower or downhole end. Two spaced apart shoulders 208 and 210 formed in the housing 200 near the pin end 206 receive the downhole end of the insert 202, as best seen in FIG. 16. As shown in FIG. 16, there is no retaining structure at the uphole end of the housing 200; the hydrostatic pressure of the fluid passing through the tool is sufficient to prevent upward movement of the insert 202.

Figure 17:
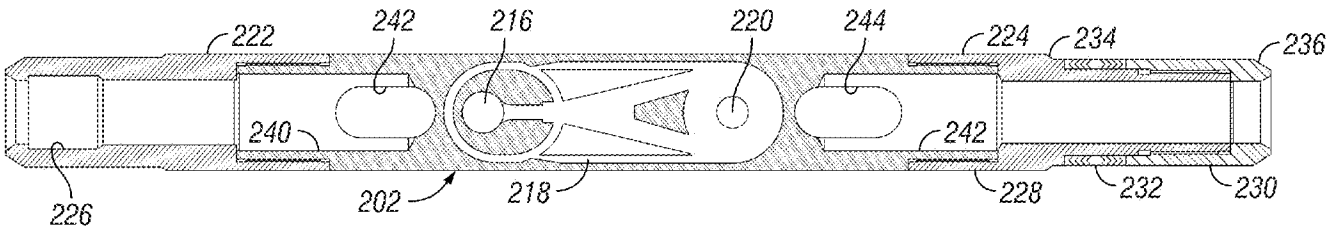
FIG. 17 is a longitudinal sectional view of the insert of the tool in FIG. 14 apart from the housing.

Like the insert 70 of the previous embodiment, the insert 202 is formed of two halves of a cylindrical metal bar, with the flow path 218 formed in the opposing inner faces. As best seen in FIG. 17, in this embodiment, the two halves are held together with threaded tubular fittings 222 and 224 at the uphole and downhole ends. The upper fitting 222 is provided with a standard internal fishing neck profile 226. Of course, an external fishing neck profile would be equally suitable.

The lower fitting 224 preferably comprises a seal assembly. To that end, it may include a seal mandrel 228 and a seal retainer 230 with a seal stack 232 captured therebetween. A shoulder 234 is provided on the mandrel 228 to engage the inner shoulder 208 of the housing 200, and a tapered or chamfered end at 236 on the retainer 228 is provided to engage the inner shoulder 210 of the housing.

As best seen in FIGS. 14 and 17, the uphole end of the insert 202 defines a cylindrical recess 240, and a slot 242 is formed through the sidewall of this recess. Similarly, the downhole end of the insert 202 defines a cylindrical recess 242, and the sidewall of this recess includes a slot 244. The slot 242 forms a passageway to direct fluid from the recess 240 around the outside of the insert and back into the inlet 216 of the flow path 218. Likewise, the slot 244 forms a fluid passageway between the outlet 220 of the flow path 218 down the outside of the insert and back into the recess 242 in the downhole end.

When constructed in accordance with the embodiment of FIGS. 14-17, the present invention provides a backpressure tool from which the variable flow resistance device, that is, the insert, is retrievable without removing the drill string 34 (FIG. 1) from the wellbore 36. Because it includes a standard fishing profile, the insert 202 can be removed using slickline, wireline, jointed tubing, or coiled tubing. With the insert 202 removed, the housing 200 of the tool 50A provides for "full bore" access to the bottom hole assembly and the well below. Additionally, the insert 202 can be replaced and reinstalled as often as necessary through the drilling operation.

In each of the above-described embodiments, the variable flow resistance device comprises a single flow path. However, the device may include multiple flow paths, which may be arranged for serial or parallel flow. Shown in FIGS. 18-24 is an example of a backpressure pulsing tool that comprises multiple flow paths arranged for parallel flow to increase the maximum flow rate through the tool. Additionally, the insert in this tool is selectively operable by means of a retrievable plug.

Figure 18:
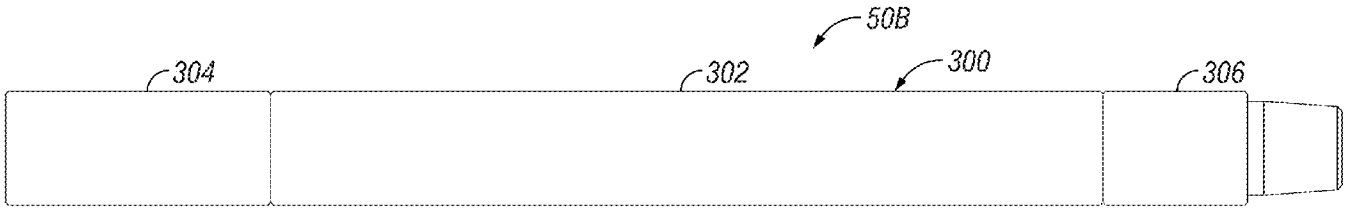
FIG. 18 is a side elevational view of yet another embodiment of the tool of the present invention in which the insert comprises multiple flow paths and the tool is initially deployed with a removable plug.
Figure 19:
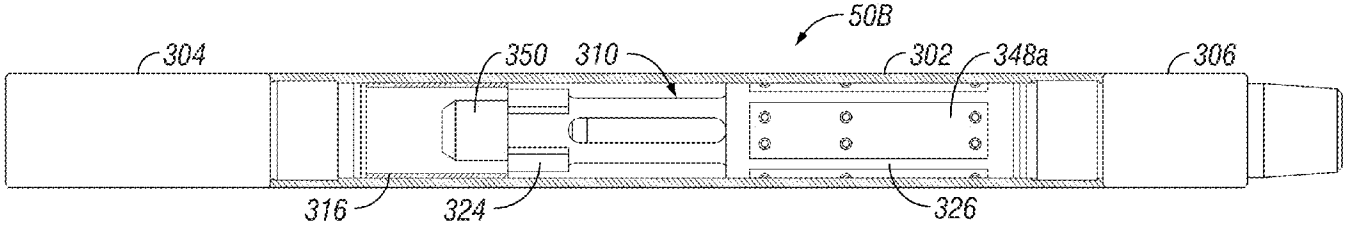
FIG. 19 is a longitudinal view of the tool of FIG. 18. The housing body is cut away to show the backpressure insert.
Figure 20:
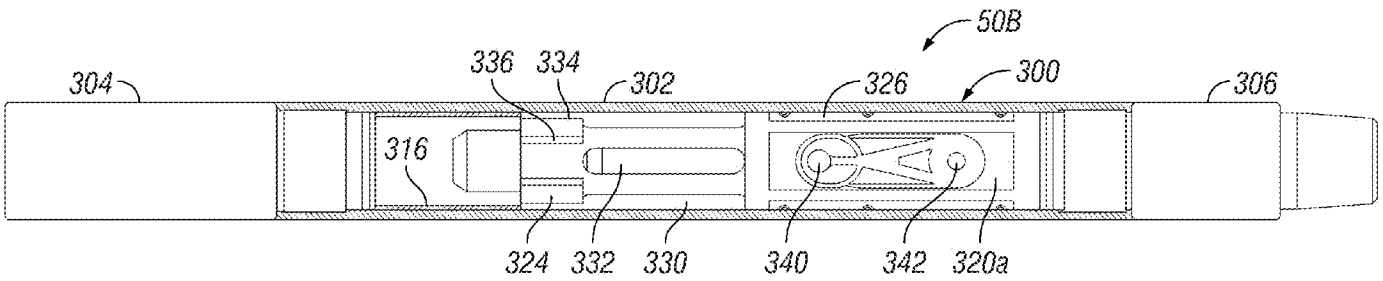
FIG. 20 is a longitudinal view of the tool of FIG. 18. The housing body is cut away and one of the closure plates is removed to show the flow path.

Side views of the tool, designated as 50B, are shown in FIGS. 18-20. The tool 50B comprises a housing 300 which may include a tool body 302, a top sub 304, and a bottom sub 306. As in the previous embodiments, the uphole end of the top sub 304 is a box joint and the downhole end of the bottom sub 306 is a pin joint. The insert 310 is captured inside the tool housing 300 by the upper end 312 of the bottom sub 306 and downhole end 314 of the top sub 304. A thin tubular spacer 316 may be used to distance the upper end of the insert 310 from the top sub 304.

Figure 24:
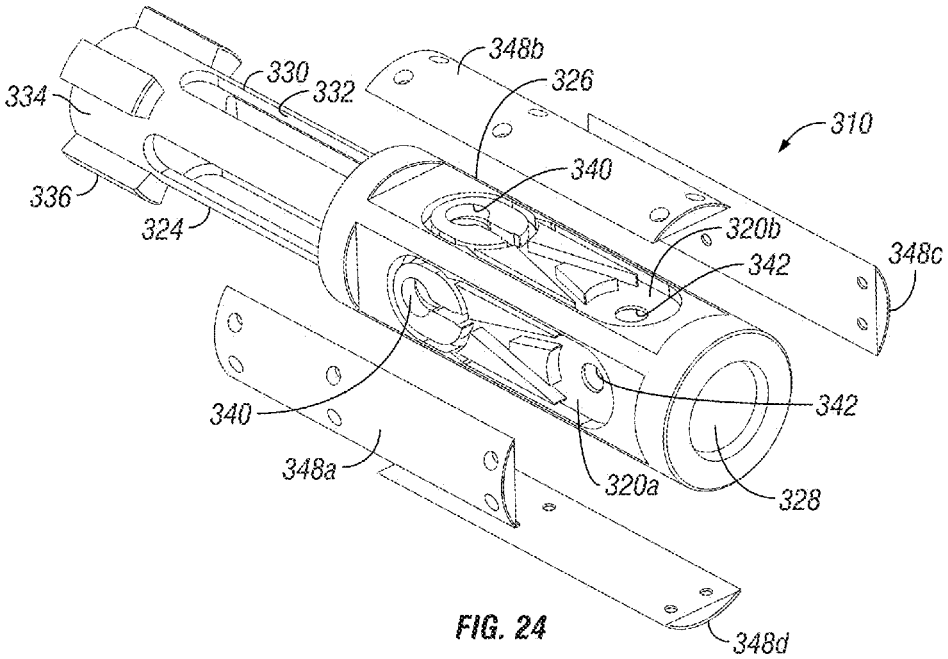
FIG. 24 is an exploded perspective view of the insert of the tool of FIG. 18.
Figure 25:
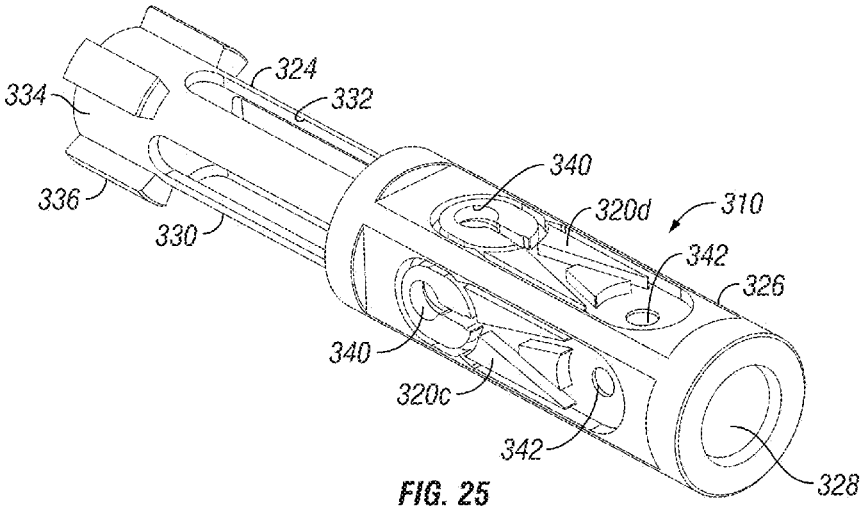
FIG. 25 is a perspective view of the insert of the tool of FIG. 18 rotated 180 degrees.
Figure 26:
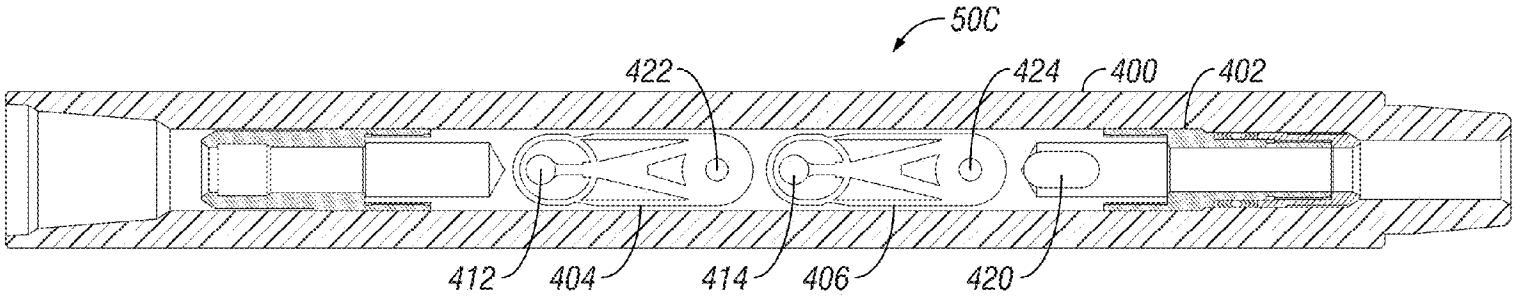
FIG. 26 is a longitudinal sectional view of another embodiment of an insert for use in a tool in accordance with the present invention. In this embodiment, two flow paths are arranged end to end and for parallel flow.
Figure 27:
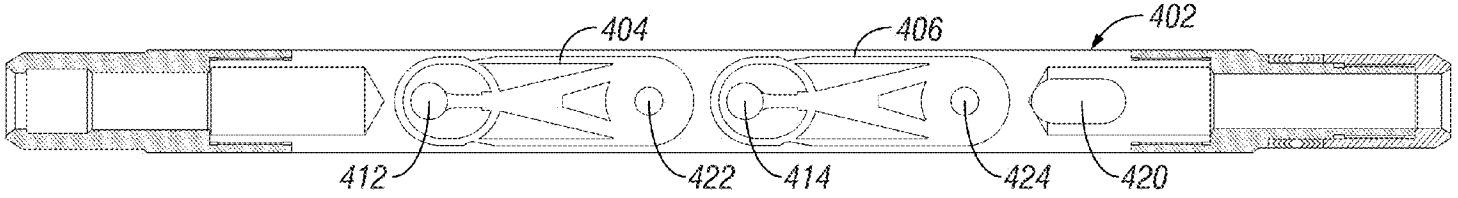
FIG. 27 is a longitudinal sectional view of the insert of the tool shown in FIG. 26.

Referring now also to FIGS. 24 and 25, the insert 310 provides a plurality of flow paths arranged circumferentially. In this preferred embodiment, there are four flow paths 320*a*, 320*b*, 320*c*, and 320*d*; however, the number of flow paths may vary. The configuration of each of the flow paths 320*a-d* may be the same as shown in FIG. 8.

The insert 310 generally comprises an elongate tubular structure having an upper flow transmitting section 324 and a lower flow path section 326 both defining a central bore 328 extending the length of the insert. The flow transmitting section 324 comprises a sidewall 330 having flow passages formed therein, such as the elongate slots 332. The upper end 334 of the flow transmitting section 324 has external splines 336. The flow paths 320*a-d* are formed in the external surface of the flow path section 326, which has an open center forming the lower part of the central bore 328. The inlets 340 and outlets 342 of the flow paths 320*a-d* all are continuous with this central bore 328. Now it will be seen that the structure of the insert 310 allows fluid flow through the central bore 328 as well as between the splines 336 and the slots 332.

The insert further comprises closure plates 348*a-d* (FIG. 24), one for enclosing each of the flow paths 320*a-d*. Thus, fluid entering the inlets 340 is forced through each of the flow paths 320*a-d* and out the outlets 342.

Figure 21:
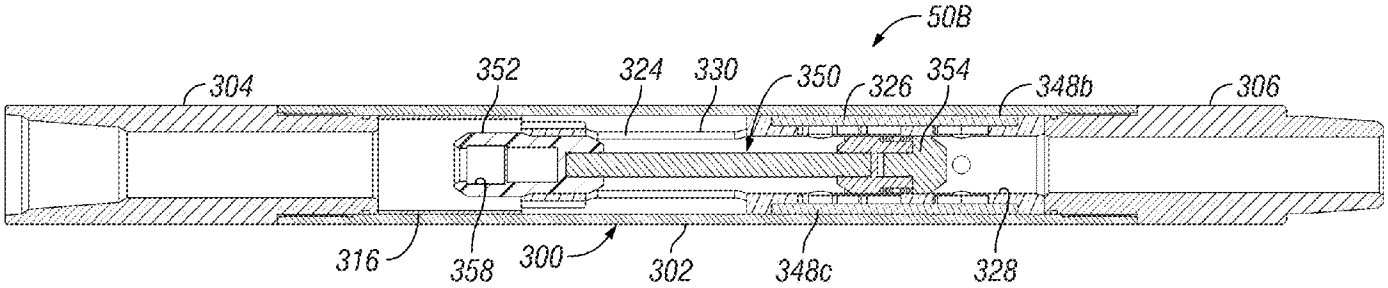
FIG. 21 is a longitudinal sectional view of the tool of FIG. 18 showing the tool with the plug in place.
Figure 22:
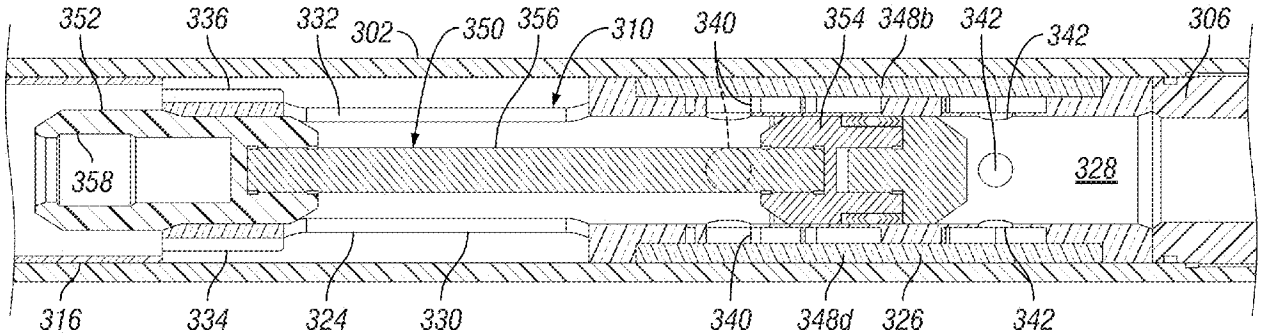
FIG. 22 is an enlarged, fragmented, longitudinal sectional view of the tool of FIG. 18 with the plug in place.
Figure 23:
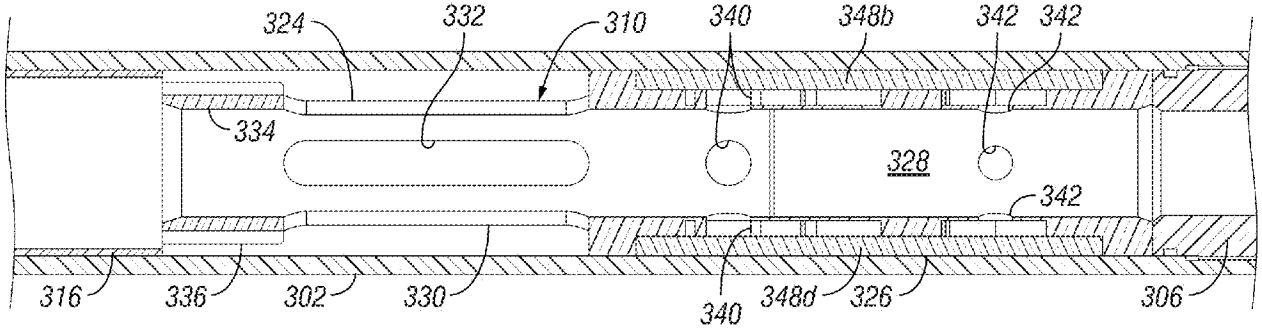
FIG. 23 is an enlarged, fragmented, longitudinal sectional view of the tool of FIG. 18 with the plug removed.

With particular reference now to FIGS. 21-23, the tool 50B further comprises a retrievable plug 350 that prevents flow through the central bore 328 and forces fluid entering the top sub 304 through the flow paths 320*a-d*. More specifically, the plug 350 forces fluid to flow between the splines 336, through the slots 332 and up through the inlets 340. A preferred structure for the plug 350 comprises an upper plug member 352, a lower plug member 354, and a connecting rod 356 extending therebetween but of narrower diameter.

The inner diameter of the splined upper portion 334 and the outer dimension of the upper plug member 352 are sized so that the upper plug member is sealingly receivable in the upper portion. Similarly, the inner dimension of the flow path section 326 and the outer dimension of the lower plug member 354 are selected so that the lower plug member is sealingly receivable in the central bore portion of the flow path section.

Additionally, the length of the lower plug member 354 is such that the lower plug member does not obstruct either the inlets 340 or the outlets 342. In this way, when the plug 350 is received in the insert 310, fluid flow entering the tool 50B flows between the external splines 336, through the slots 332 in the sidewall 324, then into the inlets 340 of each of the flow passages 320*a-d*, and then out the outlets 342 of the flow paths back into the central bore 328 and out the end of the tool.

The tool 50B is deployed in a bottom hole assembly 32 (FIG. 1) with the plug 350 installed. When desired, the plug 350 can be removed by conventional fishing techniques using an internal fishing profile 358 provided in the upper end of the upper plug member 352. The plug 350 can be reinstalled in the tool 50B downhole without withdrawing the drill string 34. Thus, the removable plug 350 permits the tool to be selectively operated.

Turning now to FIGS. 26-29, yet another embodiment of the backpressure tool of the present invention will be described. The tool 50C is similar to the tool 50A (FIGS. 14-17) in that it comprises a housing 400 and a retrievable insert 402. The housing 400 and insert 402 of the tool 50C is similar to the housing 200 and insert 202 of the embodiment 50A, except that the insert includes two flow paths 404 and 406 arranged end to end.

Figure 28:
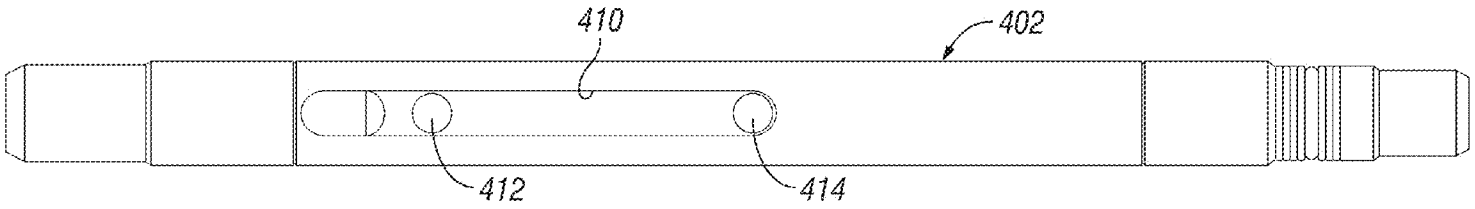
FIG. 28 is a side elevational view of a first side of the insert of FIG. 27 showing the inlet slot.
Figure 29:
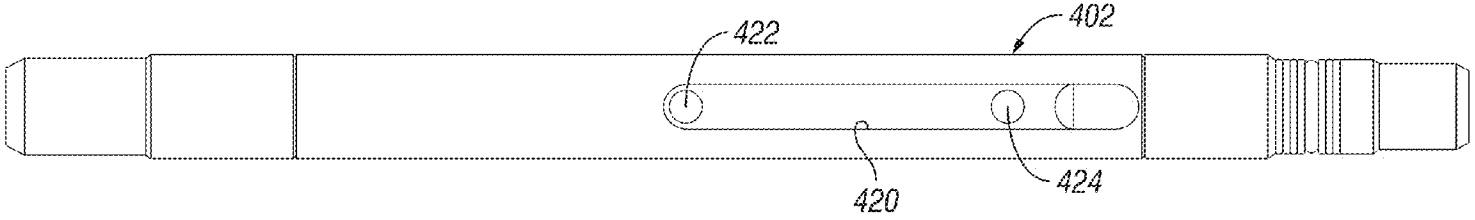
FIG. 29 is a side elevational view of the opposite side of the insert of FIG. 27 showing the outlet slot.

As shown in FIG. 28, an elongate slot 410 formed in the outer surface of one half of the insert 402 directs fluid into both the inlets 412 and 414 of the flow paths 404 and 406, and the slot 420 directs fluid from the outlets 422 and 424 back into the lower end of the tool housing 400. Thus, in this embodiment, flow through the two flow paths 404 and 406 is parallel even though the paths are arranged end to end.

In like manner, inserts could be provided with three more "in-line" flow paths. Alternately, the external slots on the insert could be configured to provide sequential flow. For example, the outlet of one flow path could be fluidly connected by a slot to the inlet of the next adjacent flow path. These and other variations are within the scope of the present invention.

Figure 30:
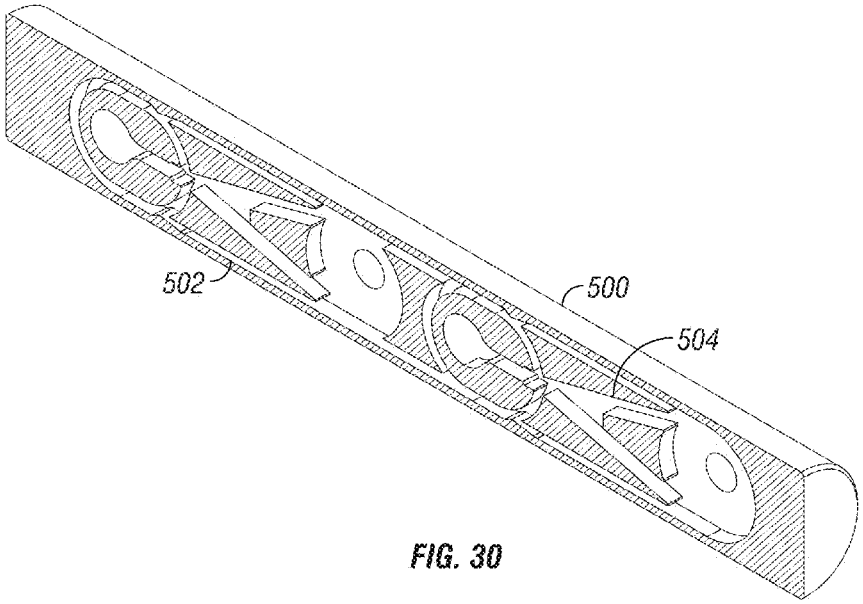
FIG. 30 shows a perspective view of another embodiment of the variable resistance device of the present invention. The inside of one half of a two part insert is shown. Two in-line flow paths are fluidly connected to have synchronized operation.
Figure 31:
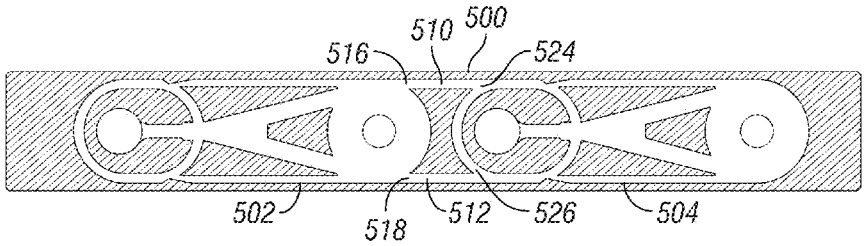
FIG. 31 is a side elevational view of the inside of the insert half illustrated in FIG. 30.

FIGS. 30 and 31 show one face of an insert 500 made in accordance with another embodiment of the present invention. This embodiment is similar to the previous embodiment of FIGS. 26-29 in that it employs two flow paths 502 and 504 arranged end-to-end with parallel flow. However, in this embodiment, the flow paths are fluidly connected by first and second inter-path channels 510 and 512. The vortex chamber 514 of the first flow path 502 has first and second auxiliary openings 516 and 518, and the return loop 520 of the second flow path 504 has first and second auxiliary openings 524 and 526. The fluid connection between the two flow paths 502 and 504 provided by the inter-path channels 510 and 512 cause the two flow paths to have synchronized operation.

Figure 32:
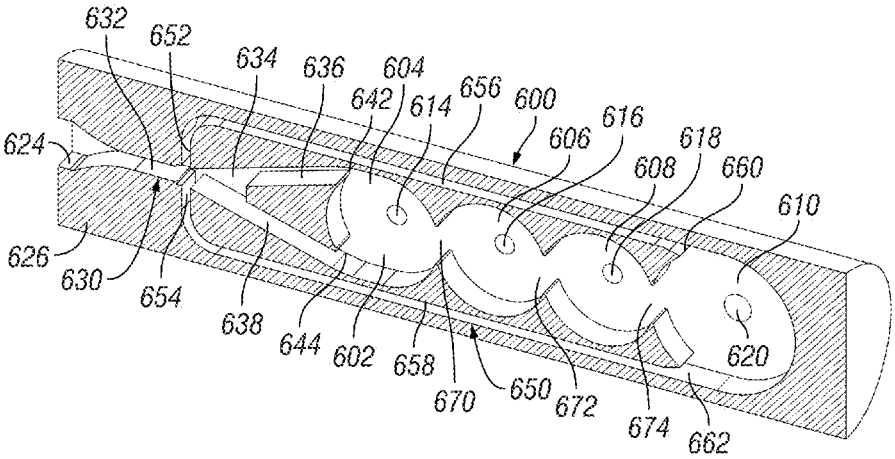
FIG. 32 shows a perspective view of another embodiment of the variable resistance device of the present invention. The inside of one half of a two part insert is shown. The flow path comprises four vortex chambers through which fluid flows sequentially. Each of the chambers has an outlet.
Figure 33:
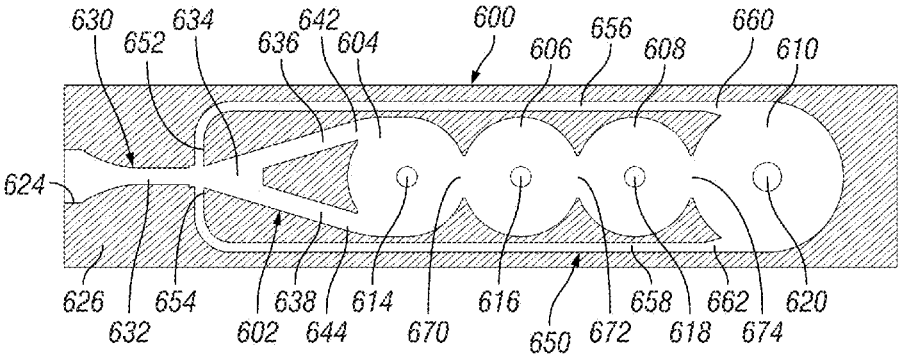
FIG. 33 is a side elevational view of the inside of the insert half illustrated in FIG. 32.

Shown in FIGS. 32 and 33 is yet another embodiment of the variable flow resistance device of the present invention. In this embodiment, the device 600 has a single flow path 602 with a plurality of adjacent, fluidly inter-connected vortex chambers. The flow path 602 may be formed in an insert mounted in a housing in a manner similar to the previous embodiments, although the housing for this embodiment is not shown.

The plurality of vortex chambers includes a first vortex chamber 604, a second vortex chamber 606, a third vortex chamber 608, and a fourth or last vortex chamber 610. Each of the vortex chambers has an outlet 614, 616, 618, and 620, respectively. The chambers 604, 606, 608, and 610 are linearly arranged, but this is not essential. The diameters of the first three chambers 604, 606, and 608 are the same, and the diameter of the fourth and last chamber 610 is slightly larger.

The device 600 has an inlet 624 formed in the upper end 626. When the insert is inside the housing, fluid entering the uphole end of the housing will flow directly into the inlet 624. Fluid exiting the outlets 614, 616, 618, and 620 will pass through the side of the insert and out the downhole end of the housing, as previously described.

The device 600 also includes a switch for changing the direction of the vortex flow in the first vortex chamber 604. Preferably, the switch is a fluidic switch. More preferably, the switch is a bi-stable fluidic switch 630 comprising a nozzle 632, jet chamber 634 and diverging inlet channels 636 and 638, as previously described. The inlet 624 directs fluid to the nozzle 632. The first and second inlet channels 636 and 638 fluidly connect to the first vortex chamber 604 through first and second inlet openings 642 and 644.

The device 600 further comprises a feedback control circuit 650 similar to the feedback control circuits in the previous embodiments. The jet chamber 634 includes first and second control ports 652 and 654 which receive input from first and second feedback control channels 656 and 658. The channels 656 and 658 are fluidly connected to the last vortex chamber 610 at first and second feedback outlets 660 and 662. Now it will be appreciated that the larger diameter of the last vortex chamber 610 allows the feedback channels to be straight and aligned with a tangent of the vortex chamber, facilitating flow into the feedback circuit.

As in the previous embodiments, fluid flowing in a first clockwise direction will tend to shear off and pass down the second feedback channel 658, while fluid flowing in a second, counter-clockwise direction will tend to shear off and pass down the first feedback channel 656. As in the previous embodiments, fluid entering the first vortex chamber 604 through the first inlet opening 642 will tend to form a clockwise vortex, and fluid entering the chamber through the second inlet opening 644 will tend to form a counter-clockwise vortex. However, since the flow path 602 includes four interconnected vortex chambers, as described more fully hereafter, a clockwise vortex in the first vortex chamber 604 creates a counter-clockwise vortex in the fourth, last vortex chamber 610.

Accordingly, the first or counter-clockwise feedback channel 656 connects to the first control port 652 to switch the flow from the first inlet channel 636 to the second inlet channel 638 to switch the vortex in the first chamber 604 from clockwise to counter-clockwise. Similarly, the second or clockwise feedback channel 658 connects to the second control port 654 to switch the flow from the second inlet channel 638 to the first inlet channel 636 which changes the vortex in the first chamber 604 from counter-clockwise to clockwise. In other words, with an even number of fluidly interconnected vortex chambers, the return loop of the previous embodiments is unnecessary.

Referring still to FIGS. 32 and 33, the multiple vortex chambers 604, 606, 608, and 610 generally direct fluid downstream from the inlet 624 to the outlet 620 in the last vortex chamber 610. To that end, the flow path 602 includes an inter-vortex opening 670, 672, and 674 between each of the adjacent chambers 604, 606, 608, and 610. Each inter-vortex opening 670, 672, and 674 is positioned to direct fluid in opposite, tangential paths out of the upstream vortex chamber and into the downstream vortex chamber. In this way, fluid in a clockwise vortex will tend to exit through the inter-vortex opening in a first direction and fluid in a counter-clockwise vortex will tend to exit through the inter-vortex opening in a second, opposite direction. Fluid exiting a vortex chamber from a clockwise vortex will tend to form a counter-clockwise vortex in the adjacent vortex chamber, and fluid exiting from a counter-clockwise vortex will tend to form a clockwise vortex in the adjacent vortex chamber.

For example, the inter-vortex opening 670 between the first vortex chamber 604 and the second vortex chamber 606 directs fluid from a clockwise vortex in the first chamber to form a counter-clockwise vortex in the second chamber. Similarly, the inter-vortex opening 672 between the second chamber 606 and the third chamber 608 directs fluid from a counter-clockwise vortex in the second chamber into a clockwise vortex in the third chamber.

Finally, the inter-vortex opening 674 between the third vortex chamber 608 and the fourth, last vortex chamber 610 directs fluid from a clockwise vortex in the third chamber into a counter-clockwise vortex in the last chamber. This, then, "flips" the switch 630 to reverse the flow in the jet chamber and initiate a reverse chain of vortices, which starts with a counter-clockwise vortex in the first chamber 604 and ends with a counter-clockwise vortex in the last chamber 610.

Directing attention now to FIGS. 34A and 34B, the operation of the multi-vortex flow path 600 will be explained with reference to sequential flow modulation drawings. In view 1, fluid from the inlet is jetted from the nozzle into the jet chamber and begins by adhering to the second inlet channel. Most of the flow exits the vortex outlet, creating a high flow, low flow resistance condition. In view 2, a counter-clockwise vortex begins to form in the first chamber, which redirects most of the flow out the inter-vortex opening tangentially into the second vortex chamber in a clockwise direction. Most of the flow in the second vortex chamber exits the vortex outlet.

In view 3, a vortex begins forming in the second vortex chamber, redirecting the fluid through the inter-vortex opening into the third vortex chamber. Most of the flow in the third chamber exits the vortex outlet in that chamber.

In view 4, the vortex in the third chamber is building, and most of the fluid begins to flow into the fourth, last chamber. Initially, most of the fluid flows out the vortex outlet. In view 5, the clockwise vortex in the fourth chamber continues to build.

At this point, as seen in view 7, there are vortical flows in each of the vortex chambers, and flow resistance is significantly increasing. In view 8, flow resistance is high and fluid begins to shear off at the feedback outlets in the last vortex chamber and starts to enter the jet chamber through the second (lower) control port. View 9 shows continued high resistance and growing strength at the control port.

As flow changes from the second inlet channel to the first inlet channel, as seen in view 10, the vortex in the first chamber begins to decay and reverse, which allows increased flow into the first chamber and begins to reduce resistance to flow through the device. View 11 illustrates collapse of the first vortex, and minimal flow resistance in the first chamber. As shown in view 12, high flow in the first inlet channel causes a clockwise vortex to begin to form, flow resistance begins to increase again and the process repeats in the alternate direction through the chambers.

Figure 35:
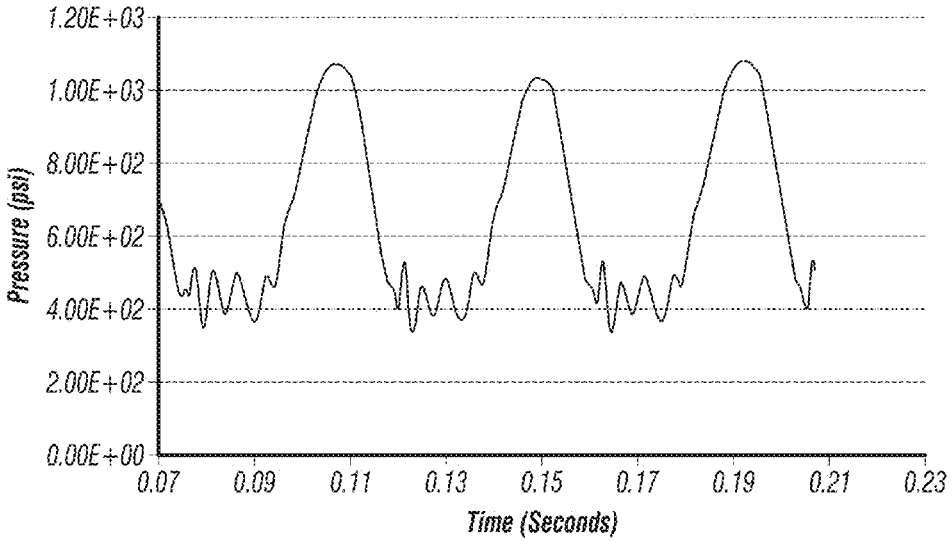
FIG. 35 is a CFD generated back-pressure pulse waveform of a tool constructed in accordance with the embodiment of FIG. 32.

The CFD generated backpressure waveform illustrated in FIG. 35 shows the effect of the four interconnected vortex chambers. This graph is calculated based on a 2.88 inch diameter tool at 3 bbl/min constant flow rate and a presumed hydrostatic pressure of 1000 psi. As fluid flows from one chamber to the next, there are three small pressure spikes between the larger pressure fluctuations, having a backpressure frequency of about 25 Hz. It will also be noted that because of the multiple small spikes caused by the first three vortex chambers, the time between larger backpressure spikes is prolonged. Thus, the duty cycle is significantly lower as compared to that of the first embodiment illustrated in FIG. 10. This means that the average backpressure created above the tool will be lower.

Figure 36:
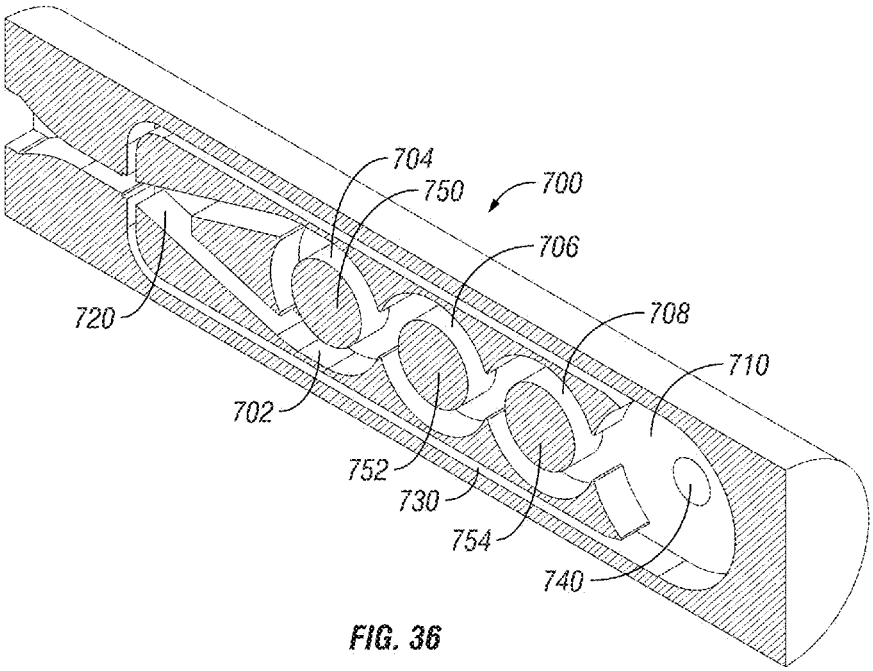
FIG. 36 shows a perspective view of another embodiment of the variable resistance device of the present invention. The inside of one half of a two part insert is shown. The flow path comprises four vortex chambers through which fluid flows sequentially. Only the last of the chamber has an outlet.
Figure 37:
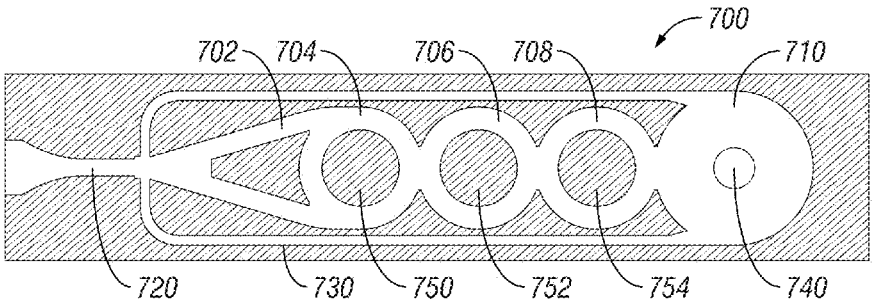
FIG. 37 is a side elevational view of the inside of the insert half illustrated in FIG. 36.

FIGS. 36 and 37 illustrate another embodiment of the device of the present invention. This embodiment, designated generally at 700, is similar to the previous embodiment of FIGS. 32-33 in that the flow path 702 comprises four adjacent, fluidly interconnected vortex channels 704, 706, 708 and 710, a bi-stable fluidic switch 720, and a feedback control circuit 730. However, in this embodiment, there is no vortex outlet in the first, second, and third chambers 704, 706, and 708. Rather, all fluid must exit the device through the vortex outlet 740 in the last, fourth vortex chamber 710. Cylindrical islands 750, 752, and 754 are provided in the center of the first, second, and third vortex chambers 704, 706, and 708 to shape the flow through the chamber so that it exits in an opposite, tangential direction into the downstream chamber.

Figure 38:
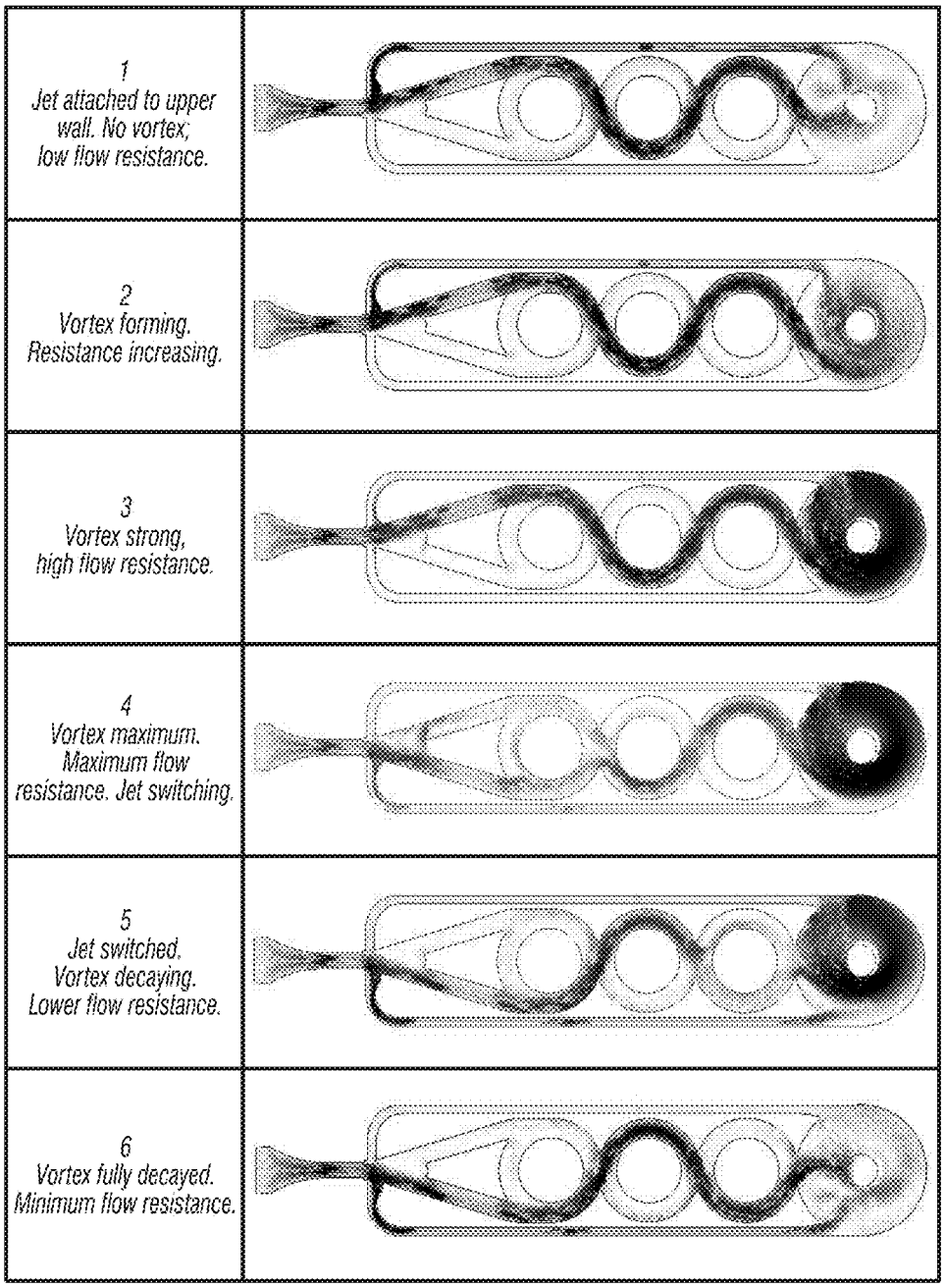
FIG. 38 is a sequential schematic illustration of fluid flow through the flow path illustrated in FIG. 36.

The operation of the multi-vortex flow path 700 will be explained with reference to sequential flow modulation drawings of FIG. 38. View 1 shows the jet flow attaching to the first (upper) inlet channel and passing through the first three vortex chambers in a serpentine shape and it maneuvers around the center islands. There is low flow resistance, as no vortex has yet formed in the fourth chamber. In view 2, a vortex is building in the fourth vortex chamber and flow resistance is increasing.

In view 3, the vortex is strong, and flow resistance is high. In view 4, the vortex is at maximum strength providing maximum flow resistance. Fluid forced into the feedback control channel is starting to switch the flow in the jet chamber. In view 5, the jet has switched to the second (lower) inlet channel, and the vortex begins to decay. In view 6, the vortex in the fourth chamber has collapsed, and flow resistance is at its lowest.

Figure 39:
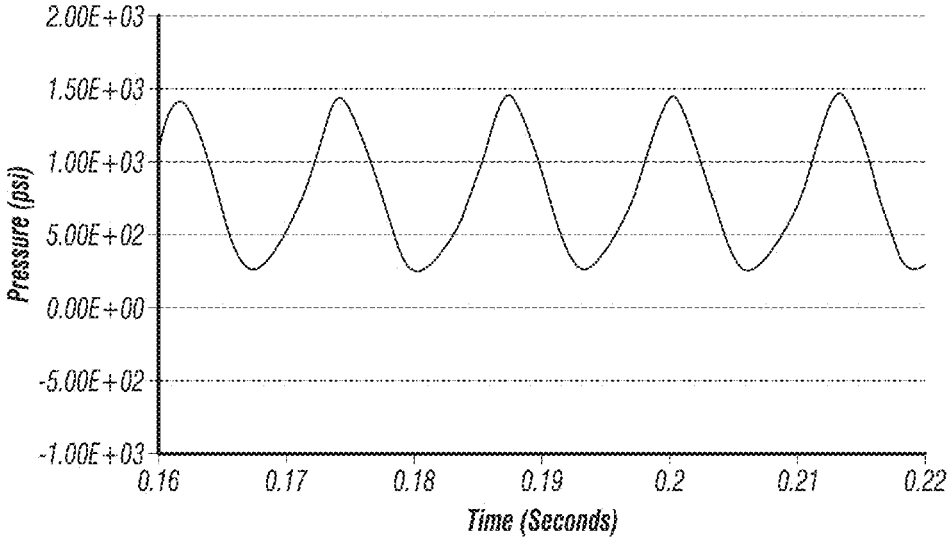
FIG. 39 is a CFD generated back-pressure pulse waveform of a tool constructed in accordance with the embodiment of FIG. 36.

The CFD generated backpressure waveform produced by a device made in accordance with FIGS. 36 and 37 is illustrated in FIG. 39. This waveform shows that the absence of vortex outlets in the first three vortex chambers eliminates the intermediate fluctuations in the backpressure, which were produced by the embodiment of FIGS. 32-35. However, the frequency of the larger backpressure waves, which is about 77 Hz, is still advantageously slow.

Figure 40:
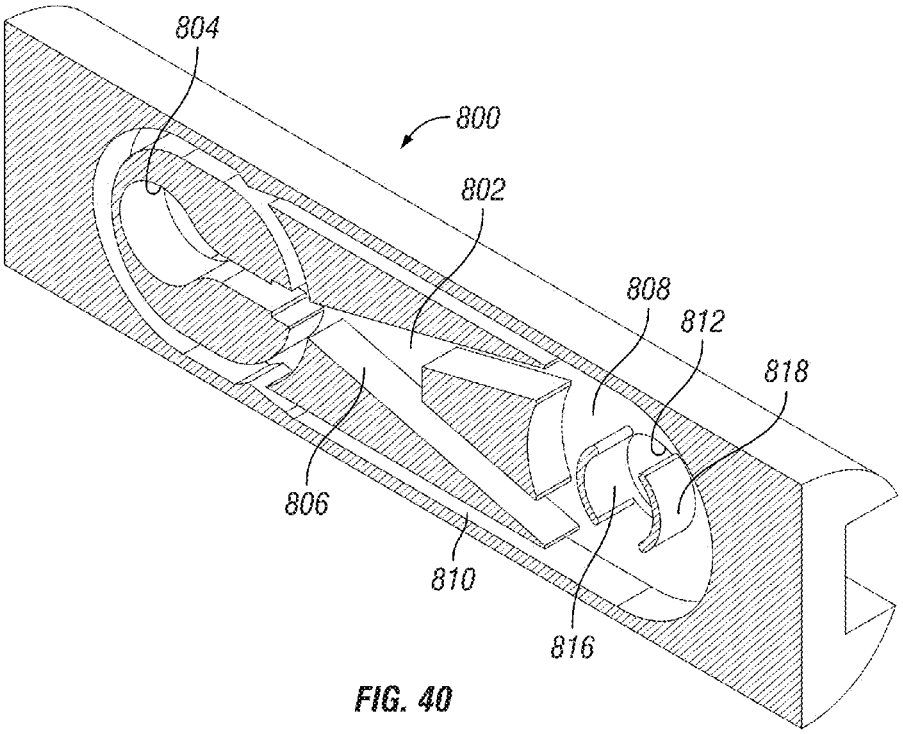
FIG. 40 shows a perspective view of another embodiment of the variable resistance device of the present invention. The inside of one half of a two part insert is shown. The flow path is similar to the embodiment of FIG. 2, but also includes a pair of vanes partially surrounding the outlet in the vortex chamber.
Figure 41:
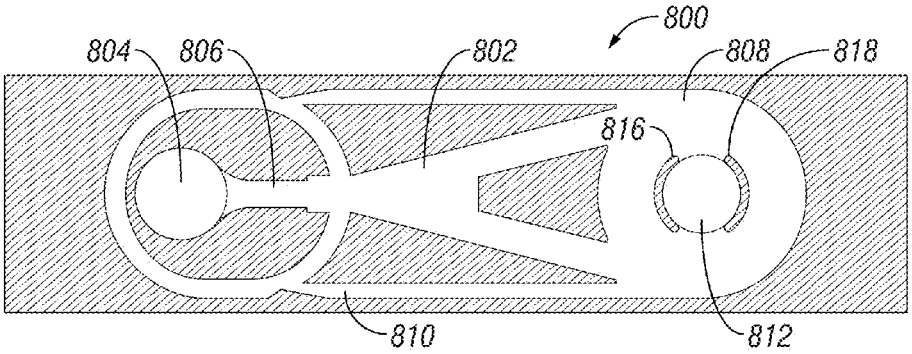
FIG. 41 is a side elevational view of the insert half shown in FIG. 40.

Turning now to FIGS. 40 and 41 is still another embodiment of the device of the present invention. The device 800 is shown as an insert for a housing not shown. The flow path 802 is similar to the flow path of the embodiment of FIGS. 2-8. Thus, the flow path 802 commences with an inlet 804 and includes a fluidic switch 806, vortex chamber 808, and feedback control circuit 810. However, in this embodiment, one or more vanes are provided at the vortex outlet 812, and the outlet is slightly larger.

Figure 42:
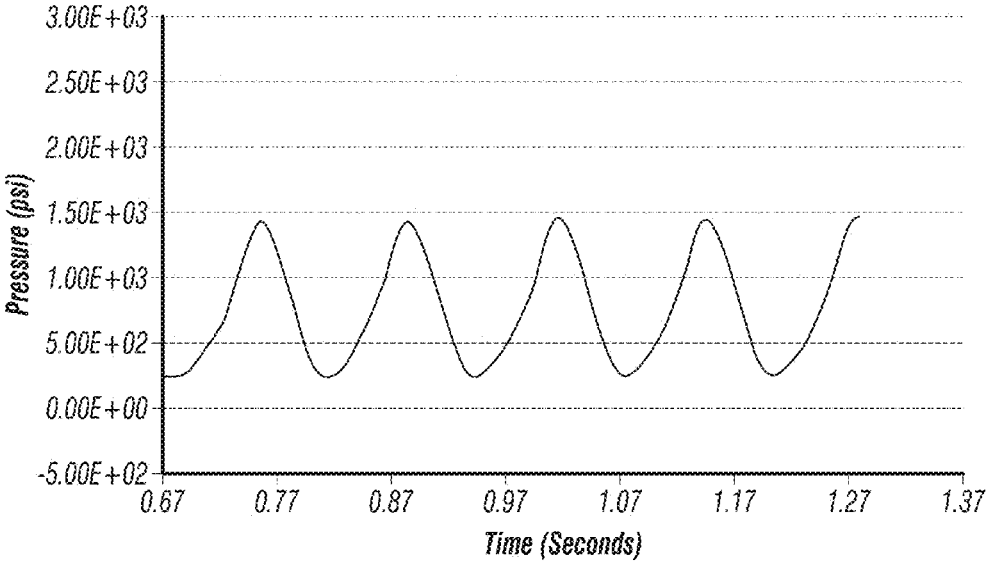
FIG. 42 is a CFD generated back-pressure pulse waveform of a tool constructed in accordance with the embodiment of FIG. 40.

Preferably, the plurality of vanes include first and second vanes 816 and 818, and most preferably these vanes are identically formed and positioned on opposite sides of the outlet 812. However, the number, shape and positioning of the vanes may vary. The vanes 816 and 818 partially block the outlet 812 and serve to slow the exiting of the fluid from the chamber. This substantially reduces the switching frequency, as illustrated in the waveform shown in FIG. 42. The frequency of this embodiment is computed at about 8 Hz, as compared to the pressure wave of FIG. 10, which is 33 Hz. Thus, the addition of the vanes and the larger outlet decreases the frequency while maintaining a similar wave pattern.

Figure 43:
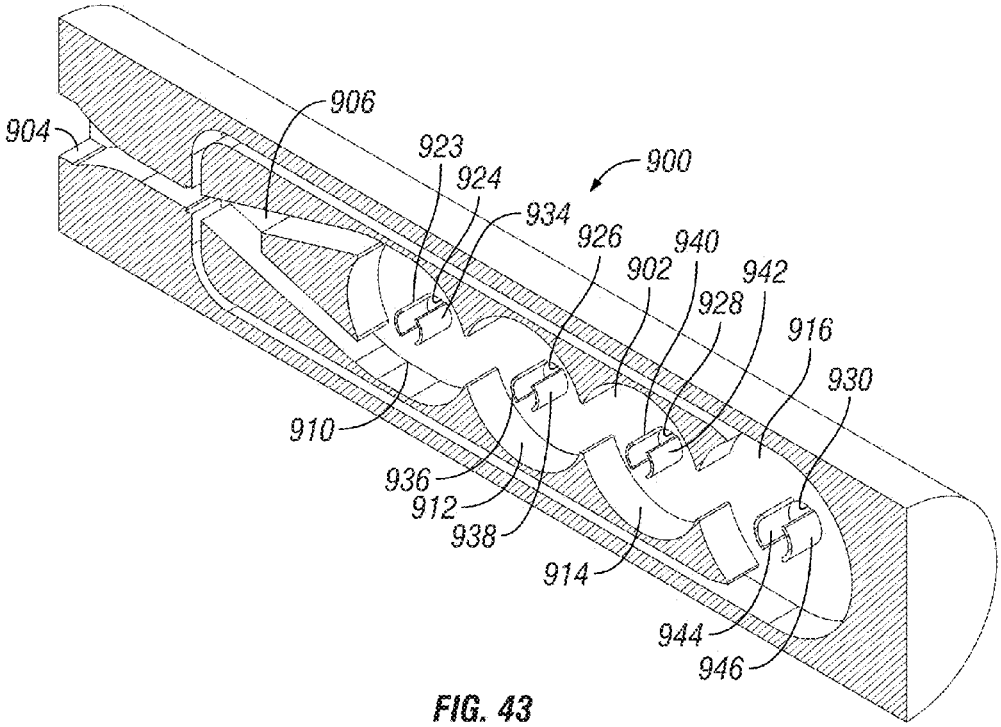
FIG. 43 shows a perspective view of another embodiment of the variable resistance device of the present invention. The inside of one half of a two part insert is shown. The flow path is similar to the embodiment of FIG. 32, but also includes a pair of vanes partially surrounding the outlet in each of the four vortex chambers.
Figure 44:
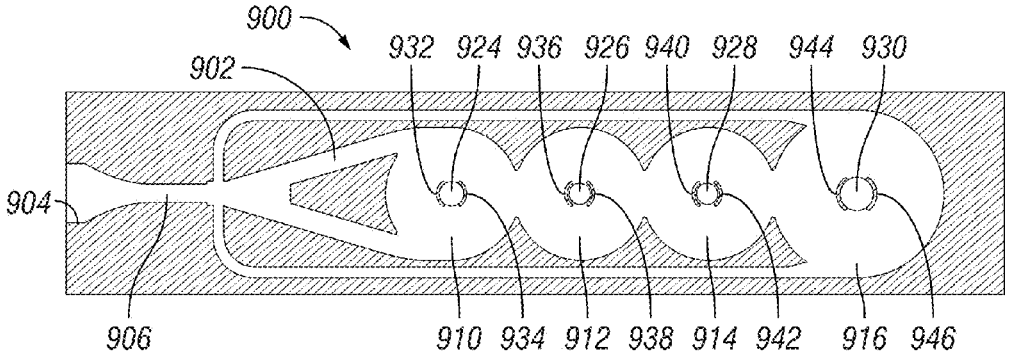
FIG. 44 is a side elevational view of the insert half shown in FIG. 43.

The embodiment of FIGS. 32 and 33, discussed above, has four vortex chambers, each with a vortex outlet. FIGS. 43 and 44 illustrate a similar design with the addition of vanes on each of the outlets. The flow path 902 of the device, designated generally at 900, includes an inlet 904, a fluidic switch 906, four vortex chambers 910, 912, 914, and 916, and a feedback control circuit 920. Each of the chambers 910, 912, 914, and 916, has an outlet 924, 926, 928, and 930, respectively. Each outlet 924, 926, 928, and 930, has vanes 932 and 934, 936 and 938, 940 and 942, and 944 and 946, respectively.

Figure 45:
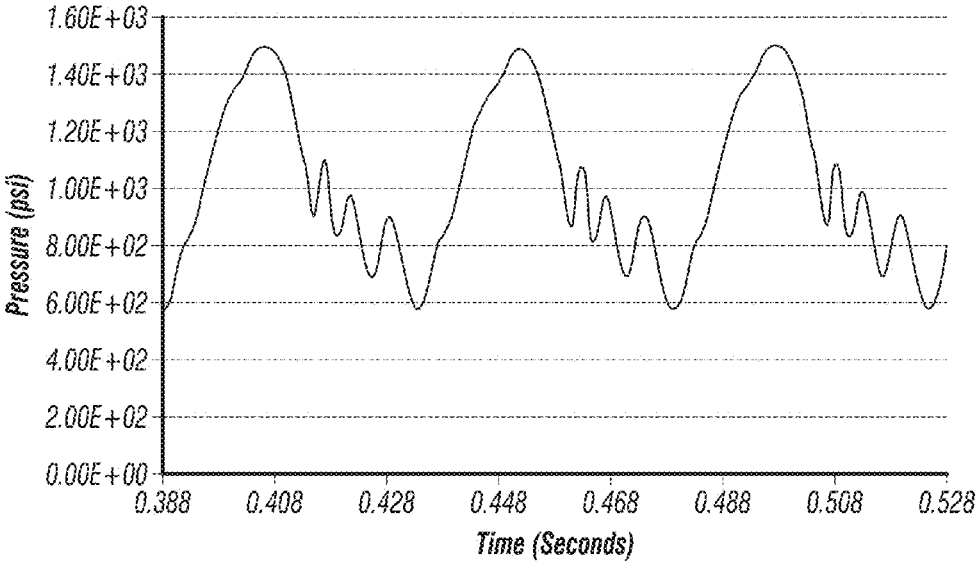
FIG. 45 is a CFD generated back-pressure pulse waveform of a tool constructed in accordance with the embodiment of FIG. 43.

A comparison of the waveform shown in the graph of FIG. 45 to the waveform in FIG. 35 reveals how the addition of vanes to the vortex outlets changes the wave pattern. Specifically, the flow path with the vanes has the three small spikes between the larger backpressure spikes, but the amplitude of the small spikes gradually steps down in size.

Figure 46:
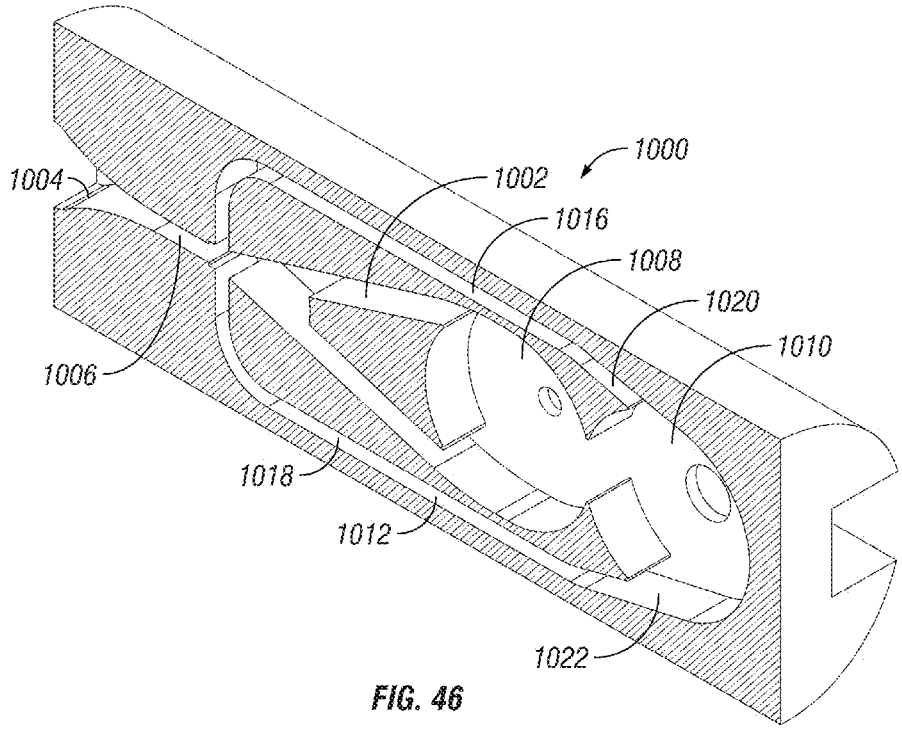
FIG. 46 shows a perspective view of another embodiment of the variable resistance device of the present invention. The inside of one half of a two part insert is shown. The flow path includes two vortex chambers, with the end chamber connected by feedback channels to the jet chamber. Both vortex chambers have the same diameter and the feedback channels are angled outwardly from the exit openings.
Figure 47:
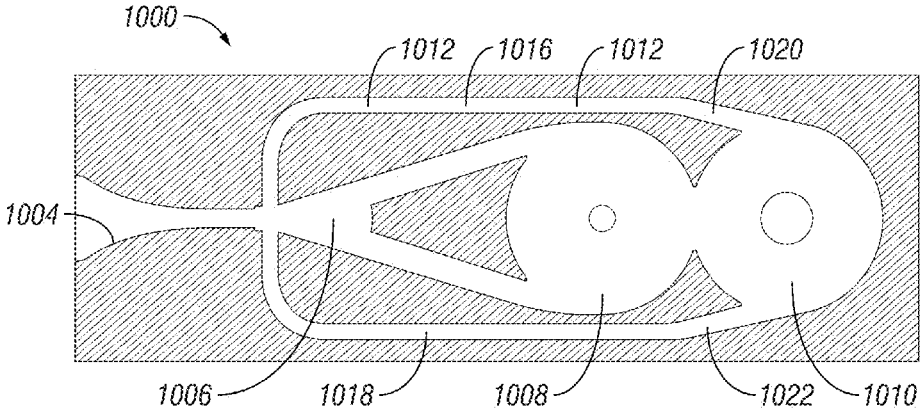
FIG. 47 is a side elevational view of the insert half shown in FIG. 46.

FIGS. 46 and 47 show another embodiment of the device of the present invention. This embodiment, designated at 1000, is similar to the embodiment shown in FIGS. 32 and 33, except there are only two vortex chambers. Here it should be noted that while the present disclosure shows and describes flow paths with two and four vortex chambers, any even number of vortex chambers may be used.

The flow path 1002 commences with an inlet 1004 and includes a fluidic switch 1006, first and second vortex chambers 1008 and 1010, and feedback control circuit 1012. As explained previously, the return loop of the first embodiment is eliminated as the vortex is reversed in the second or last vortex chamber 1010.

In this configuration, the diameter of the last vortex chamber 1010 is the same as the first vortex chamber 1008. The feedback control channels 1016 and 1018 are modified to include diverging angled sections 1020 and 1022 that extend around the periphery of the first vortex chamber 1008.

Figure 48:
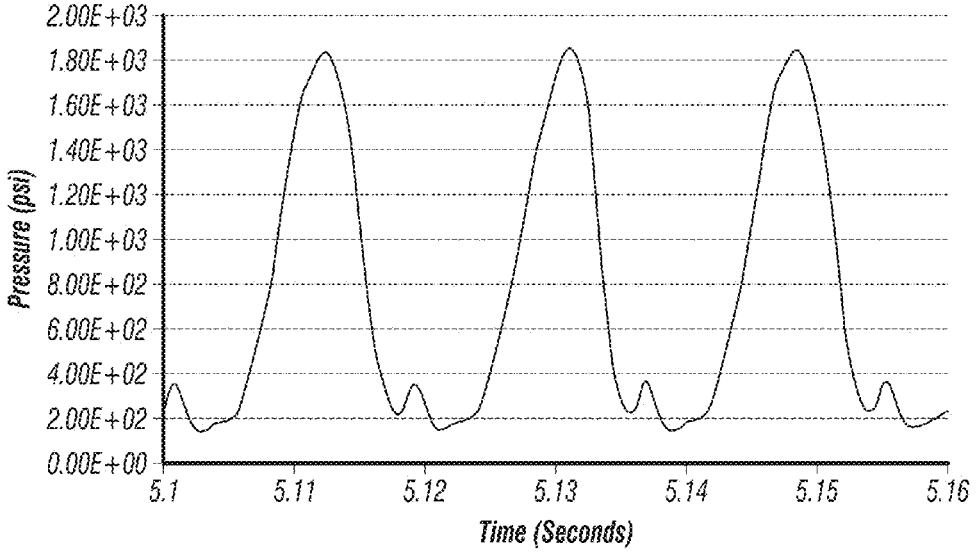
FIG. 48 is a CFD generated back-pressure pulse waveform of a tool constructed in accordance with the embodiment of FIG. 46.

As shown in the waveform seen in FIG. 48, the additional vortex chamber provides a long low-resistance period in each cycle. The single fluctuation represents the decay of the vortex in the first chamber 1008. The cycle frequency is about 59 Hz, and the one additional vortex chamber provides a small spike between the large spikes lowering the duty cycle, as compared to the wave pattern in FIG. 10. The smaller diameter of the last (second) vortex chamber connected to the feedback control circuit results in a slightly increased frequency.

Figure 49:
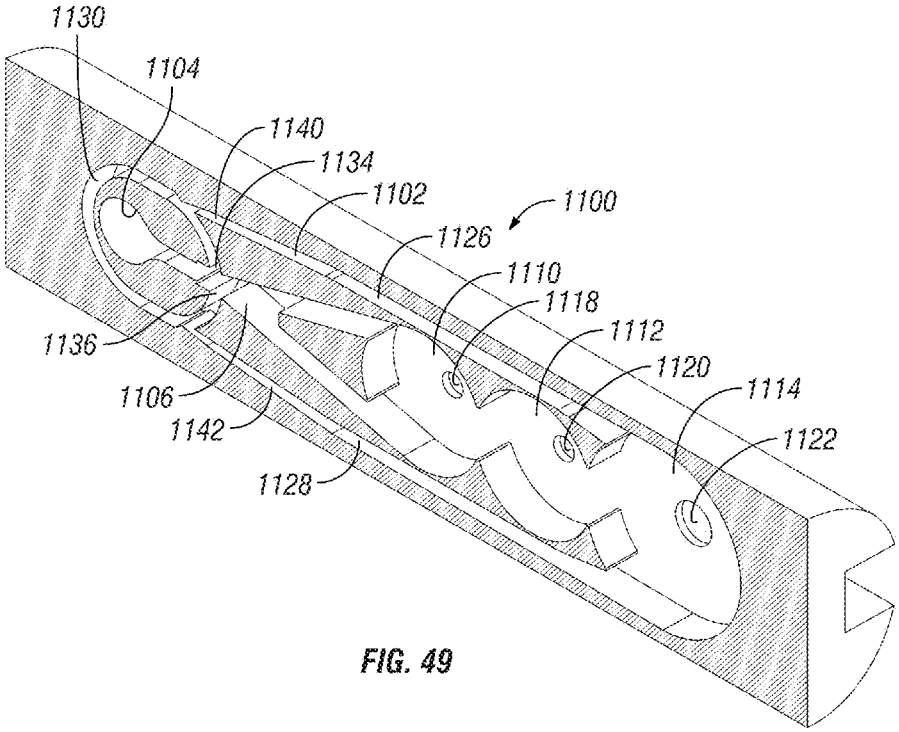
FIG. 49 shows a perspective view of another embodiment of the variable resistance device of the present invention. The inside of one half of a two part insert is shown. The flow path includes three vortex chambers, with the end chamber connected by feedback channels to a return loop for directing the flow to the correct side of the jet chamber. The end vortex chamber has a larger diameter than the first two chambers, and the feedback channels extend straight back from the exit openings.
Figure 50:
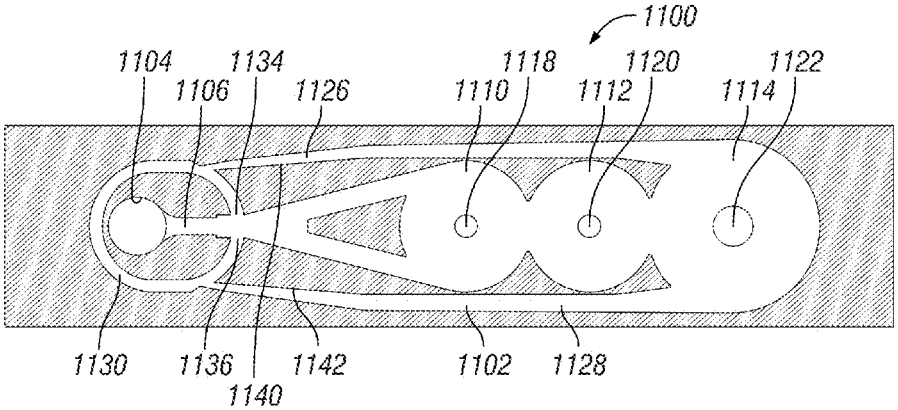
FIG. 50 is a side elevational view of the insert half shown in FIG. 49.

The flow path of the device of the present invention may use an odd number of vortex chambers. One example of this is seen in FIGS. 49 and 50. The device 1100 includes a flow path 1102 with an inlet 1104, a switch 1106, and three vortex chambers 1110, 1112, and 1114. Here it should be noted that while the present disclosure shows and describes flow paths with one and three vortex chambers, any odd number of vortex chambers may be used.

Each of the vortex chambers has a vortex outlet 1118, 1120, and 1122, respectively. The diameter of the last vortex chamber 1122 is slightly larger than the diameter of the first two chambers 1118 and 1120, so the feedback channels 1126 and 1128 extend straight off the sides of the chamber.

A return loop 1130 is included to direct the feedback flow to the control port 1134 and 1136 on the opposite side of the jet chamber 1138. The diameter of the return loop in this embodiment is less than the diameter of the last vortex chamber 114. Inwardly angled and tapered sections 1140 and 1142 in the feedback channels 1126 and 1128 accommodate the reduced diameter.

Figure 51:
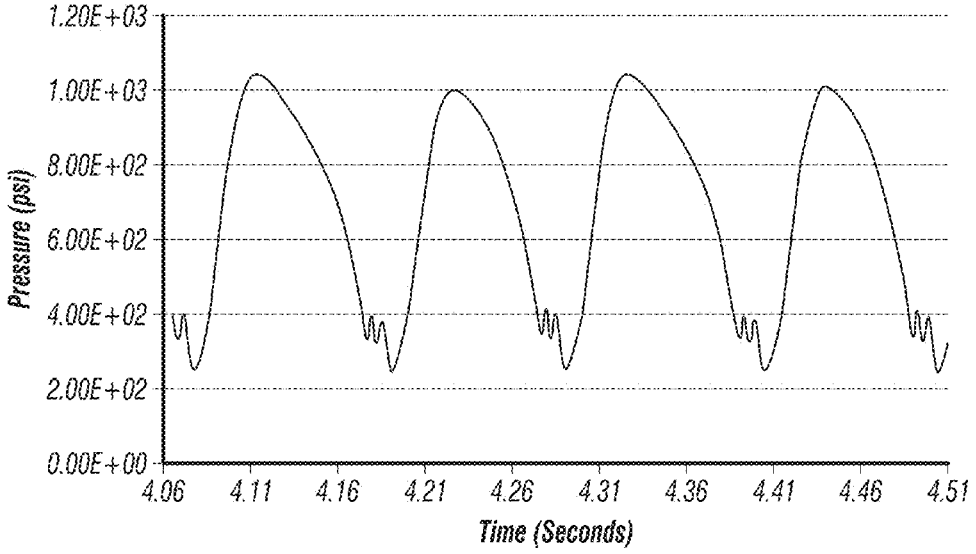
FIG. 51 is a CFD generated back-pressure pulse waveform of a tool constructed in accordance with the embodiment of FIG. 49.

The CFD generated waveform shown in FIG. 51 demonstrates the reduced frequency of about 9 Hz and a prolonged low resistance period (lower duty cycle) achieved by the multiple vortex chambers, as compared to the waveform of the single-chamber flow path embodiment of FIG. 10.

Figure 52:
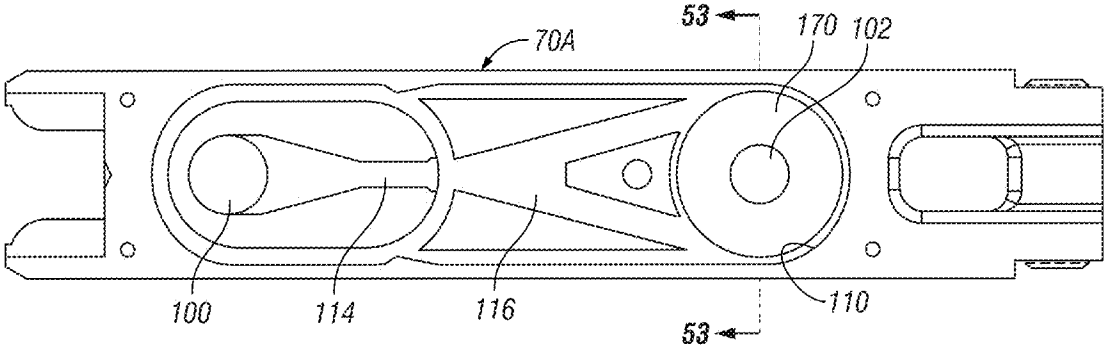
FIG. 52 is an inside view of one half of a fluidic insert similar to the embodiment of FIGS. 5-7. In this embodiment, the insert includes an erosion-resistant liner positioned at the outlet of the vortex chamber.
Figure 53:
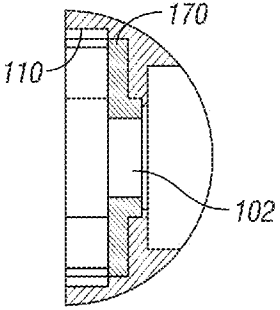
FIG. 53 is a cross-sectional view of the liner of FIG. 52 taken along line 53-53 of FIG. 2.
Figure 54:
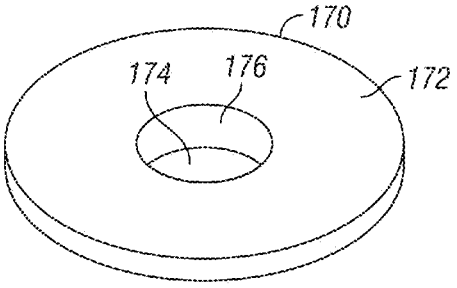
FIG. 54 is a perspective view of the upper or exposed side of the liner.
Figure 55:
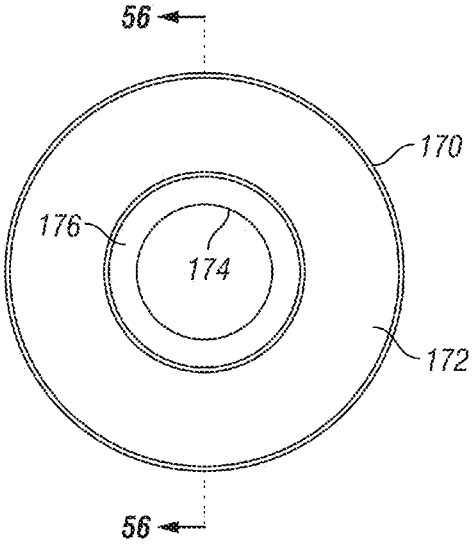
FIG. 55 is a bottom view of the liner.
Figure 56:
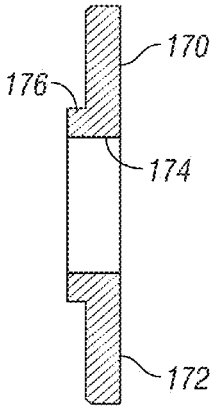
FIG. 56 is a sectional view of the liner taken along line 56-56 of FIG. 55.

Turning now to FIGS. 52-56, another feature of the present invention will be described. FIG. 52 shows the inside of one of the halves of an insert similar to the insert shown in FIGS. 5-7. The insert 70A defines a flow path 72 comprising an inlet 100 and an outlet 102. Fluid entering the inlet is directed to a nozzle 114 which forces the fluid into the jet chamber 116. From the jet chamber 116, the fluid moves into the vortex chamber 110, and some of the fluid exists the vortex chamber through the outlet 102.

Over time, the rapid and turbulent flow through the outlet 102 may erode the surface around the outlet, and eventually this erosion may affect the function of the tool. To retard this erosion process, the insert 70A is provided with an erosion-resistant liner 170. The liner 170 may take several shapes, but a preferred shape is a flat or planar annular portion or disk 172 with a center opening 174 only slightly smaller than the outlet 102. More preferably, the liner 170 further comprises a tubular portion that extends slightly into the outlet 102. This configuration protects the surface of the vortex chamber surrounding the outlet 102, the edge of the outlet opening and at least part of the inner wall of the outlet itself.

The liner 170 may be made of an erosion resistant material, such as tungsten carbide, silicone carbide, ceramic, or heat-treated steel. Surface hardening methods such as boronizing, nitriding and carburizing, as well as surface coatings such as hard chrome, carbide spray, laser carbide cladding, and the like, also may be utilized to further enhance the erosion resistance of the liner. Additionally, the liner may be made of plastic, elastomer, composite, or other relatively soft material which resists erosion. The liner 170 is sized to be soldered, press fit, shrink fit, threaded, welded, glued, captured, or otherwise secured into the outlet 102. Depending on the method used to secure the liner, the liner may be replaceable.

Figure 57:
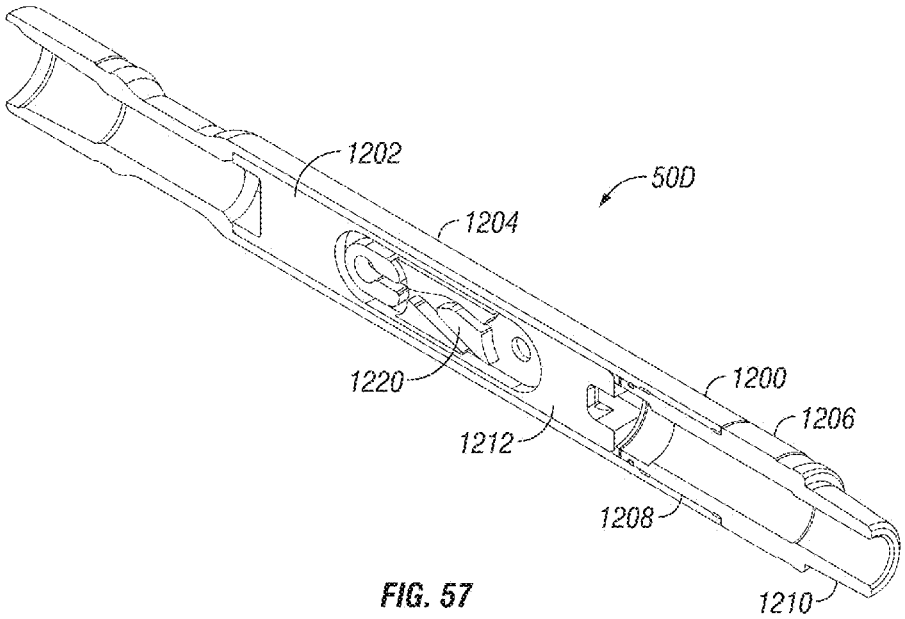
FIG. 57 is a perspective, sectional view of another embodiment of the variable resistance device of the present invention.
Figure 58:
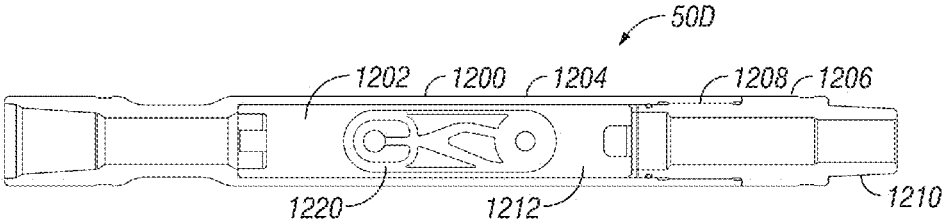
FIG. 58 is a longitudinal sectional view of the tool of FIG. 57.
Figure 59:
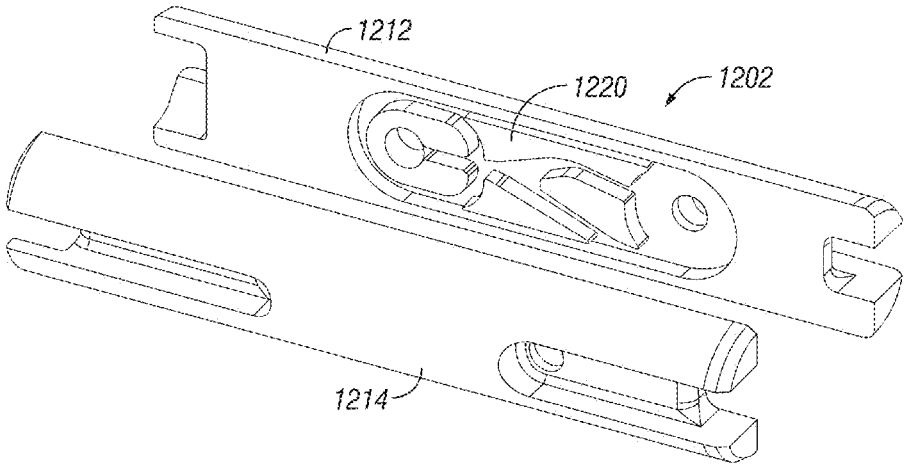
FIG. 59 is an exploded perspective view of the fluidic insert of the tool shown in FIG. 57.

Turning now to FIGS. 57-63, another embodiment of the backpressure tool of the present invention will be described. The tool 50D is similar to the tool 50 (FIGS. 2-7) in that it comprises a housing 1200 and an insert 1202. The housing 1200 and insert 1202 of the tool 50D are similar to the housing 200 and insert 202 of the embodiment 50A. As seen in FIGS. 57-59, the tool housing 1200 may include a tool body 1204 and a bottom sub 1206 joined by a conventional threaded connection 1208. The downhole end 1210 of the bottom sub 1206 may be threaded for connection to other tools or components of the BHA 32 (FIG. 1).

The tool 50D further comprises a variable flow resistance device which is formed in the insert 1202. As in the other embodiments, the insert 1202 preferably is made from a generally cylindrical structure cut in half longitudinally to form a first half 1212 and a second half 1214 (FIG. 59). The cylindrical insert 1202 is received inside the tool body 1204 in the manner previously described.

The preferred flow path 1220 for the tool 50D will be described in more detail with reference to FIG. 60, to which attention now is directed. As will become apparent, the flow path 1220 is similar in many respects to the flow path 72 of the tool 50. Fluid enters the flow path 1220 through the inlet 1222 and passes through a nozzle 1224 into a jet chamber 1226. Diverging from the jet chamber 1226 are first and second input channels 1230 and 1232 that lead to first and second inlet openings 1234 and 1236 in the periphery of a vortex chamber 1240. Axially centered in the vortex chamber 1240 is a fluid outlet 1242.

The flow path 1220 includes a switch 1244 to alternate the flow into the first and second input channels 1230 and 1232 from the jet chamber 1226. As in the previous embodiments, the switch 1244 takes the form of a Y-shaped bi-stable fluidic switch. To that end, the flow path includes first and second control ports 1246 and 1248.

As in the previous embodiments, the switch 1244 is controlled by a feedback control circuit 1250, which is also similar to the previously described embodiments. The feedback control circuit 1250 includes first and second feedback channels 1252 and 1254 that conduct fluid to the first and second control ports 1246 and 1248. The first feedback channel 1252 extends from a first feedback outlet 1256 at the periphery of the vortex chamber 1240. The second feedback channel 1254 extends from a second feedback outlet 1258 also at the periphery of the vortex chamber 1240.

The first and second feedback outlets 1256 and 1258 are positioned to direct fluid in opposite, tangential paths out of the vortex chamber 1240. Thus, when fluid is moving in a counter-clockwise vortex CCW, some of the fluid will tend to exit through the first feedback outlet 1256 into the first feedback channel 1252. Likewise, when fluid is moving in a clockwise vortex CW, some of the fluid will tend to exit through the second feedback outlet 1258 into the second feedback channel 1254.

Figure 60:
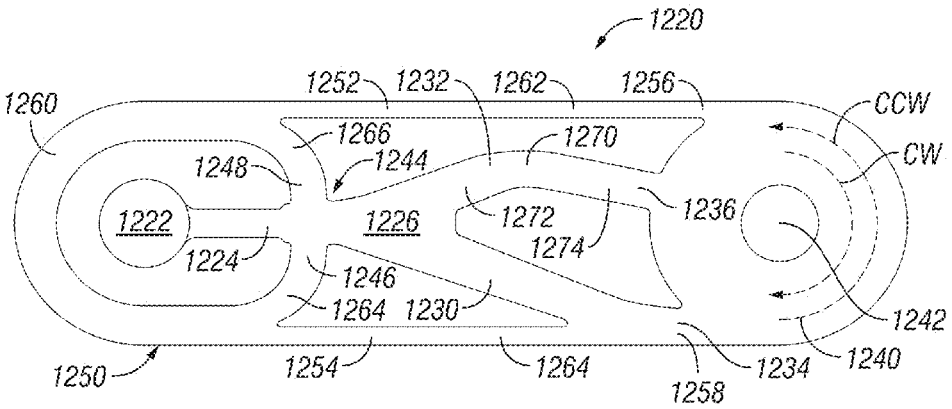
FIG. 60 is an enlarged diagram of the flow path of the tool shown in FIG. 57.

With continuing reference to FIG. 60, the first feedback channel 1252 connects the first feedback outlet 1256 to the first control port 1246 in the jet chamber 1226, and the second feedback channel 1254 connects the second feedback outlet 1258 to the second control port 1248. Although each feedback channel could be isolated or separate from the other, in this preferred embodiment of the flow path, the feedback channels 1252 and 1254 share a common curved section 1260 through which fluid flows bi-directionally.

The first feedback channel 1252 has a separate straight section 1262 that connects the first feedback outlet 1256 to the curved section 1260 and a short connecting section 1264 that connects the common curved section 1260 to the control port 1246, forming a generally J-shaped path. Similarly, the second feedback channel 1254 has a separate straight section 1264 that connects the second feedback outlet 1258 to the common curved section 1260 and a short connection section 1266 that connects the curved section to the second control port 1248.

In the previously described embodiments, the first and second input channels, and the first and second inlet openings were symmetrically formed and both directed the fluid at nearly a perfect tangent into the vortex chamber. The tangential flow creates maximum resistance in the device. Thus, with the above-described feedback circuit, the flow into the vortex chamber generated opposite vortices of equal strength that, in turn, generated alternating but equal back-pressure pulses in the drill string 34 (FIG. 1). This produces the generally sinusoidal pressure waveform shown in FIG. 10.

As explained above, one of the goals of the present invention is to provide a tool that provides large, low frequency backpressures. The previous embodiments employ symmetrical but opposite tangential flow paths into the vortex chamber to achieve relatively high back pressure. The present embodiment provides a slower "effective frequency" that more nearly approaches the resonant frequency in the drill string. More specifically, the flow path 1220 of the present embodiment generates alternating primary and secondary pulses in the well fluid in the tubular conduit. The primary pulses have an amplitude and the secondary pulses have an amplitude, and the amplitude of the primary pulses is greater than the amplitude of the secondary pulses. In some embodiments, the amplitude of the secondary pulses is less than half the amplitude of the primary pulses. These alternating pulses provide alternating high and low pressures where the low pressure pulses are so low that they do not produce significant or detectable back pressures. Instead, only the alternating higher pressure pulses provide effective back pressure, thus the term "effective frequency."

To generate alternating pulses of different strengths, the flow path may be configured to create a primary vortex and a secondary vortex where the secondary vortex is opposite in direction and weaker in strength relative to the primary vortex. The flow path 1220 in FIG. 60 is designed to achieve this effect.

The direction of the fluid flow path entering the vortex chamber may be tangential, as in the previously described embodiments. As explained above, the tangential flow path generates relatively high resistance and thus significant back pressures. However, where the direction of fluid entering the vortex chamber is radial, that is, the fluid is directed from the inlet opening directly or nearly directly to the center of the outlet, very little if any resistance is generated. While a vortex may eventually form, it will form slowly and will be relatively weak. Thus, it will generate very low back pressure in the system.

Figure 61:
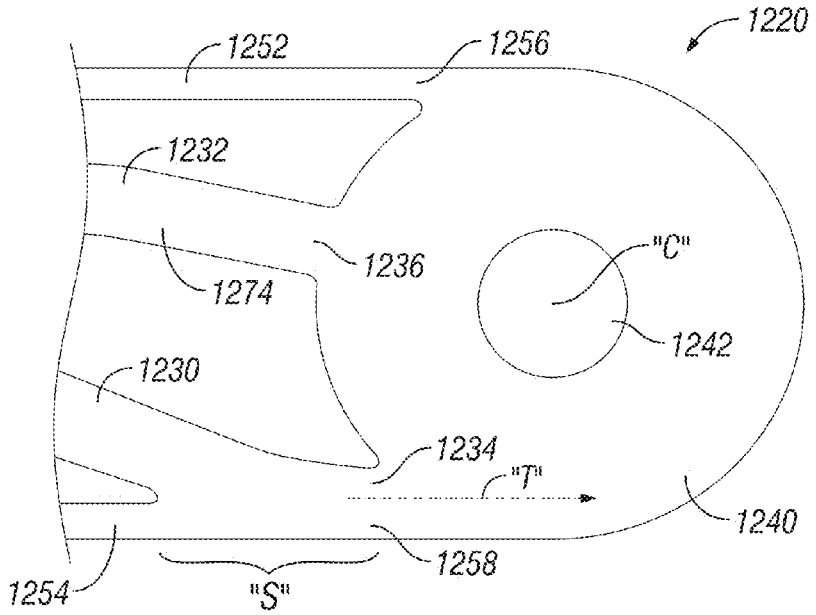
FIG. 61 is an enlarged view of the vortex chamber of the flow path shown in FIG. 57 marked to show the tangential direction of the flow entering from the first input channel.
Figure 62:
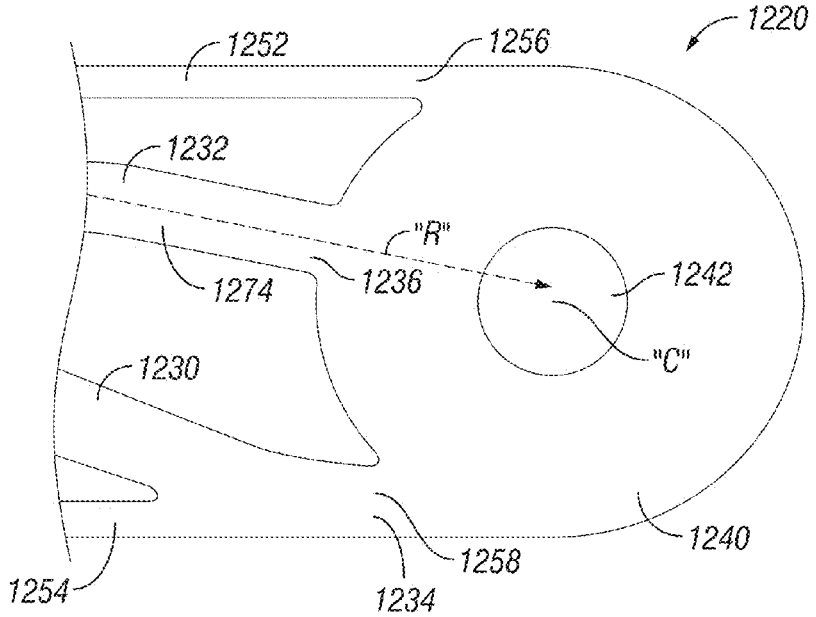
FIG. 62 is an enlarged view of the vortex chamber of the flow path shown in FIG. 57 marked to show the general direction of the flow entering from the second input channel.

Referring now also to FIG. 61, the first input channel 1230 and the first inlet opening 1234 in the vortex chamber 1240 are configured to direct fluid flow into the vortex chamber along a tangential path "T" to generate a primary vortex. The second input channel 1232 and the second inlet opening 1236, as seen in FIG. 62, are configured to direct fluid flow along a radial path "R" into the vortex chamber 1240 to produce a secondary vortex that is opposite in direction and weaker in strength relative to the primary vortex. To cause the flow to enter the vortex chamber 1240 along a radial path, the second input channel 1232 includes an angle, curve, or turn 1270, seen best in FIG. 60. To that end, in the preferred embodiment, the second input channel 1232 may comprise a first straight section 1272 and a second straight section 1274 angled relative to the first straight section.

As used herein, "along a radial flow path," "radial path," and similar phrases, mean along a flow path that is closer to radial than is the tangential flow path T of the first input channel 1230 and the first inlet opening 1234. Similarly, as used herein, "along a tangential flow path," "tangential path," and similar phrases, mean along a flow path that is closer to tangential than is the radial flow path "R" of the second input channel 1232 and the second inlet opening 1236. As shown herein, the primary vortex is counter-clockwise, and the secondary vortex is clockwise. These directions could, of course, be reversed.

Now it will be understood that in the present embodiment, the tangential path T is very close to a perfect tangent (FIG. 61), and the radial path R is very close to a precise radial path passing only slightly to the outside of the center C (FIG. 62) of the outlet 1242. This is particularly advantageous as it provides the largest difference in the relative resistances of the paths. The relative positions of these paths, however, could vary. For example, the tangential path T could be closer to the radial path R, or the radial path R could be further offset from the center C, or both. The directions the radial path R and the tangential path T may be varied depending on the particular resistances and backpressures desired.

Returning to FIG. 61, another advantageous feature of the flow path 1220 will be explained. As discussed, the first input channel 1230 and the first inlet opening 1234 are shaped and positioned to direct fluid in a tangential path "T" into the vortex chamber 1240. This is similar to the tangential paths followed by the input channels in the previous embodiments. However, in this embodiment, the first inlet opening 1234 and the second outlet opening 1258 in the second feedback channel 1254 in the vortex chamber 1240 form a single, common opening. Additionally, the first inlet channel 1230 and the second feedback channel 1254 share a common section "S" (designated by the bracket in FIG. 61) adjacent the vortex chamber 1240. This allows the incoming fluid to achieve as close to a true tangential path as possible.

Figure 63:
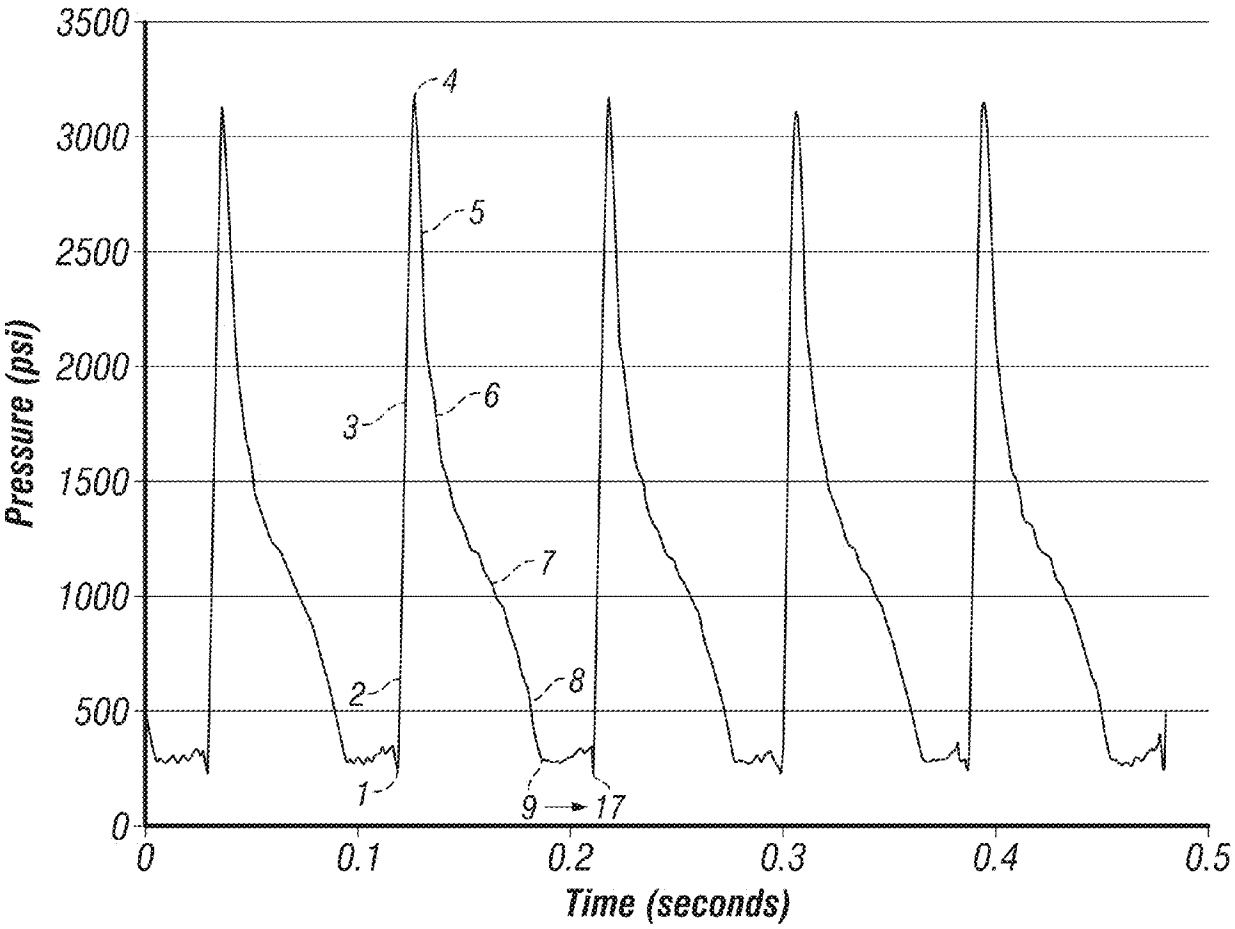
FIG. 63 is a CFD generated back-pressure pulse waveform of a tool constructed in accordance with the embodiment of FIG. 57.

The waveform generated by the preferred embodiment shown in FIGS. 57-62 is shown in FIG. 63. FIGS. 64A-C are sequential diagrammatic illustrations of the cyclical flow patterns exhibited by the above-described flow path 1220 under constant flow. The number of each diagram is shown on the waveform In the first view, fluid is entering the inlet and flowing into the first inlet channel. No vortex has yet formed, and there is minimal or low backpressure being generated. In view 2, the fluid starts to rotate around the outlet, while pressure increases. In view 3, a primary vortex is building in a counter-clockwise direction. View 4 illustrates the highest pressure point in the cycle (FIG. 63). Fluid at the periphery of the vortex chamber begins to shear off into the first feedback channel.

View 5 shows the feedback flow beginning to impinge on the fluid exiting the nozzle at the first control port, and in view 6 the fluid begins to flow through the second input channel to form the radial flow. In view 7, there is still a strong primary vortex, but the radial flow is gradually starting to disrupt the vortex. The primary vortex is decayed in view 8 and the back pressure is greatly reduced.

View 9 shows all the fluid flowing out the outlet due to the radial flow. However, as the radial flow is slightly offset of center (above the center as seen in the drawings), fluid gradually begins to rotate in a clockwise direction as shown in view 10, and in view 11 the secondary vortex is building. A solid but weak secondary vortex is formed in view 12, and in view 13 some fluid begins to shear off into the second feedback channel. View 14 shows some fluid exiting the second control port, and some of the fluid begins to flow toward the first input channel.

The secondary vortex then begins to weaken, as seen in view 15. As the flow shifts fully back to the first input channel, the tangential flow begins to collapse the secondary vortex. In view 17, the secondary vortex is gone and fluid is exiting the outlet prior to the formation of another primary vortex, at which point the cycle continues to repeat.

Referring again to the waveform in FIG. 63, it can be appreciated that the tangential flow into the vortex chamber rapidly builds the primary vortex; this is shown by the sharp rise in pressure from point 1 to point 4. However, when the input flow switches to radial, it takes longer to disrupt the primary vortex and to form a secondary vortex in the opposite direction. This is shown by the relatively gradual downward slope of the pressure curve from its peak at point 4 to the near bottom pressure at point 9. As is illustrated in the wave form, the buildup of the secondary vortex from the radial flow to its maximum resistance and pressure is slower than the formation of the primary vortex. Moreover, the peak resistance and back pressure created by the secondary vortex is substantially lower than that of the primary vortex. This is what produces the slower "effective frequency" of the inventive flow path, mentioned above.

Figure 65:
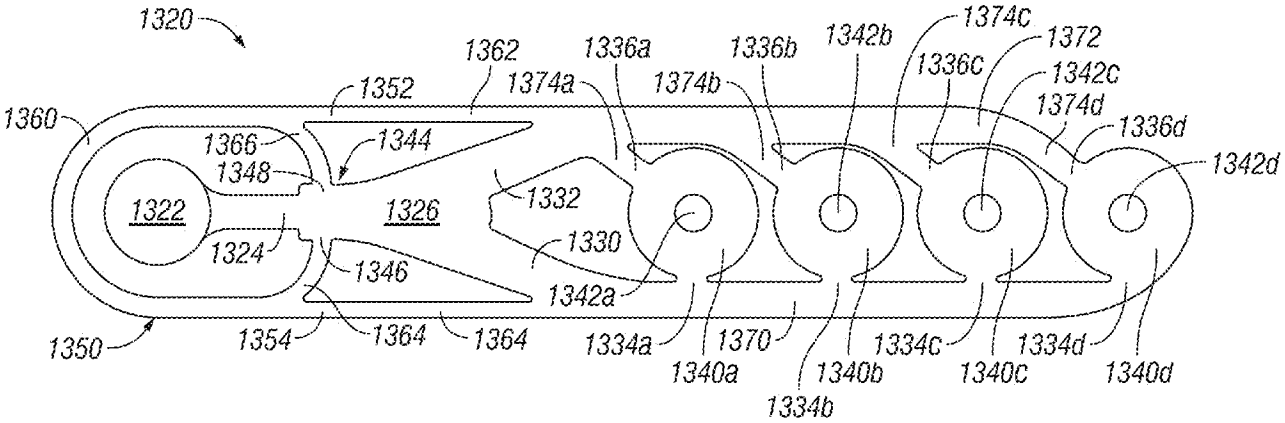
FIG. 65 is an enlarged diagram of another embodiment of the flow path similar to the flow path in FIG. 60 but including four vortex chambers configured to run in parallel.

With reference now to FIG. 65, there is shown therein an embodiment of the inventive flow path which utilizes the previously described asymmetrical (radial and tangential) input channels but includes a plurality of vortex chambers, such as the four vortex chambers shown. While the embodiment of FIG. 65 shows four chambers, alternately this number could be two, three, or more than four. This flow path may be employed in a tool as previously described.

The flow path shown in FIG. 65, designated herein at 1320, comprises an inlet 1322 where fluid enters and then passes through a nozzle 1324 into a jet chamber 1326. Diverging from the jet chamber 1326 are first and second input channels 1330 and 1332 that lead to first inlet openings 1334*a*, 1334*b*, 1334*c*, and 1334*d*, and second inlet openings 1336*a*, 1336*b*, 1336*c*, and 1336*d*, in the periphery of four vortex chambers 1340*a*, 1340*b*, 1340*c*, and 1340*d*. Axially centered in each vortex chamber 1340*a*, 1340*b*, 1340*c*, and 1340*d* is a fluid outlet 1342*a*, 1342*b*, 1342*c*, and 1342*d*.

The flow path 1320 includes a switch 1344 to alternate the flow into the first and second input channels 1330 and 1332 from the jet chamber 1326. As in the previous embodiment, the switch may take the form of a Y-shaped bi-stable fluidic switch. To that end, the flow path includes first and second control ports 1346 and 1348.

As in the previous embodiments, the switch 1344 is controlled by a feedback control circuit 1350. The feedback control circuit 1350 includes first and second feedback channels 1352 and 1354 that conduct fluid to the first and second control ports 1346 and 1348 through a bidirectional curved section 1360 that connects to connecting sections 1364 and 1366.

The plurality of vortex chambers 1340*a*, 1340*b*, 1340*c*, and 1340*d* are configured to operate in parallel, that is, so that fluid flow enters the chambers simultaneously and also exits the chambers simultaneously, whether through the center outlets 1342*a*, 1342*b*, 1342*c*, and 1342*d*, or the into the feedback circuit 1350. To that end, as seen also in FIG. 66, the flow path 1320 includes a first inlet manifold section 1370 that connects the first inlet openings 1334*a*, 1334*b*, 1334*c*, and 1334*d*, to the straight section 1364 of the second feedback channel 1354 as well as to the first input channel 1330. Thus, fluid from the first input channel 1330 enters the vortex chambers 1340*a*, 1340*b*, 1340*c*, and 1340*d* through the same openings that provide an exit to fluid entering from the second input channel 1332 into the second feedback channel 1354, in a manner similar to that provided in the flow path 1320 of FIG. 65.

Figure 66:
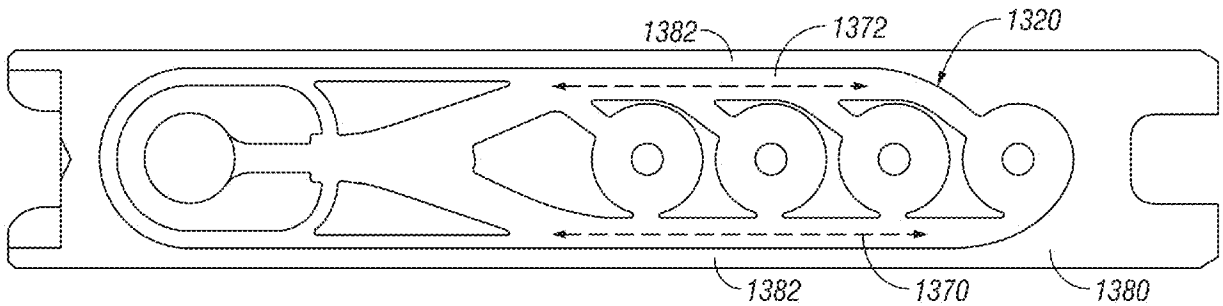
FIG. 66 is an elevational view of the inside surface of one half of an insert in which is formed a flow path as shown in FIG. 65.

Referring still to FIGS. 65 and 66, the flow path 1320 includes a second inlet manifold section 1372 that connects the second inlet openings 1336*a*, 1336*b*, 1336*c*, and 1336*d*, to the straight section 1362 of the first feedback channel 1352 as well as to the second input channel 1332. Each vortex chamber 1340*a*, 1340*b*, 1340*c*, and 1340*d* is connected to the second manifold section 1372 by a radially directed channel 1374*a*, 1374*b*, 1374*c*, and 1374*d*, respectively. Thus, fluid from the second input channel 1332 enters the vortex chambers 1340*a*, 1340*b*, 1340*c*, and 1340*d* through the same openings that provide an exit to fluid entering from the first input channel 1330 into the first feedback channel 1352.

FIGS. 67A-67C are sequential diagrammatic illustrations of the cyclical flow patterns exhibited by the above-described flow path 1320 under constant flow. In view 1, fluid is entering the inlet, flowing through the jet chamber into the first input channel and then is entering the vortex chambers simultaneously through the first manifold section. No vortices have yet formed, and there is minimal or low back-pressure being generated.

In view 2, the fluid starts to rotate around the outlets, while pressure increases. In view 3, primary counter-clockwise vortices begin to build in each vortex chamber. View 4 illustrates the highest pressure point in the cycle, and fluid at the periphery of the vortex chambers begins to shear off into the second manifold section.

View 5 shows the feedback flow beginning to impinge on the fluid exiting the nozzle at the first control port, and in view 6 the fluid has switched and is flowing into the second input channel to form the radial flows. In view 7, there is still a strong primary vortex, but the radial flow is gradually starting to disrupt the vortices. The primary vortices are decayed in view 8, and the back pressure is greatly reduced; all the fluid is flowing out the outlets due to the radial flow.

Fluid in the vortex chambers gradually begins to rotate in a clockwise direction, as shown in view 9, and in view 10 the secondary clockwise vortices are building. Weak secondary vortices are formed in view 11, and in view 12 some fluid begins to shear off simultaneously into the first manifold section. View 13 shows some fluid exiting the second control port, and some of the fluid begins to flow toward the first input channel.

The secondary vortices then weaken, as seen in view 14. As the flow shifts fully back to the first input channel, the tangential flow begins to collapse the secondary vortices. In view 15, the secondary vortices are gone, and fluid is exiting the outlets prior to the formation of another primary vortex, at which point the cycle continues to repeat.

Now it will be appreciated that the flow path 1320 prevents high velocity vortical flow from contacting the walls of the flow path nearest the outside of the insert. This helps avoid catastrophic erosion from the inside of the insert to the outside of the insert. This streamlines the vortical flow, which reduces the erosive effect of the fluid on the surfaces of the insert.

Another advantage to this flow path is provided by the manifold sections 1370 and 1372, as best seen in FIG. 66. FIG. 66 shows the inner surface of one half of an insert 1380 in which the inventive flow path 1320 is formed. The bidirectional fluid flow through the straight manifold sections 1370 and 1372, illustrated by the arrows, is substantially linear and produces relatively little turbulence. This generates less wear on the inner surfaces of the insert closest to the outer wall 1382 of the insert 1380, and prolongs the useful life of the tool.

The use of multiple vortex chambers allows the use of smaller vortex chambers, which in turn allows the overall diameter of the insert or tool containing the flow path to be reduced. This allows the tool to run in smaller boreholes and to be retrieved through the various joints and components of a typical drill string.

These advantages are possible without increasing the pressure drop across the tool. The pressure drop is a function of the diameter of the center outlet of the vortex chamber relative to the diameter of the vortex chamber. If, for example, in a single vortex flow path, the ratio of the diameter of the chamber to the outlet is 4:1, then in a comparable multi-chamber flow path, the pressure drop characteristics of both flow paths will be similar if the same ratio is used in the multiple chamber flow path and the chambers are appropriately sized to accommodate the same flow as the single vortex flow path.

Each of the above described embodiments of the variable flow resistance device of the present invention employs a switch for changing the direction of the vortex flow in the vortex chamber. As indicated previously, a fluidic switch is preferred in most applications as it involves no moving parts and no elastomeric components. However, other types of switches may be employed. For example, electrically, hydraulically, or spring operated valves may be employed depending on the intended use of the device.

In accordance with the method of the present invention, a drill string is advanced or "run" into a borehole. The borehole may be cased or uncased. The drill string is assembled and deployed in a conventional manner, except that one or more tools of the present invention are included in the bottom hole assembly and perhaps at intervals along the length of the drill string.

The backpressure tool is operated by flowing well fluid through the drill string. As used herein, "well fluid" means any fluid that is passed through the drill string. For example, well fluid includes drilling fluids and other circulating fluids, as well as fluids that are being injected into the well, such as fracturing fluids and well treatment chemicals. A constant flow rate will produce effective high backpressure waves at a relatively slow frequency, thus reducing the frictional engagement between the drill string and the borehole. The tool may be operated continuously or intermittently.

Where the tool comprises a removable insert, the method may include retrieving the device from the BHA. Where the tool comprises a retrievable plug, the plug may be retrieved. This leaves an open housing through which fluid flow may be resumed for operation of other tools in the BHA. Additionally, the empty housing allows use of fishing tools and other devices to deal with stuck bits, drilling out plugs, retrieving electronics, and the like.

After the intervening operation is completed, fluid flow may be resumed. Additionally, the insert may be reinstalled into the housing to resume use of the backpressure tool. Additionally, the insert itself may become worn or washed out, and may need to be replaced. This can be accomplished by simply removing and replacing the insert using a fishing tool.

In one aspect of the present invention, the drill string may include a plurality of backpressure tools either close together or spaced apart. Moreover, in some instances, it may be desirable to include in the drill string one or more backpressure tools with the symmetric flow paths, such as those shown in FIGS. 2-53. Alternately, the drill string may comprise one or more back pressure tools with the asymmetric flow paths of FIGS. 57-66. Still further, a combination of symmetric and asymmetric backpressure tools may be beneficial. Combining the symmetric and asymmetric backpressure tools will cause pressure fluctuations that occur at frequencies that correspond to both tools. This combination of frequencies may be more effective at reducing friction than either frequency alone.

In one aspect of the method of the present invention, nitrogen gas is mixed with a water or water-based well fluid, and this multi-phase fluid is pumped through the drill string. The use of nitrogen to accelerate the annular velocity flow and removal of debris at the bit is known. However, nitrogen degrades elastomeric components, and many downhole tools, such as the rotary valve tools discussed above, have one or more such components. Because the backpressure of the present invention has no active elastomeric components, use of nitrogen is not problematic. In fact, very high rates of nitrogen may be used.

By way of example, in a 3 bbl/minute flow rate, the well fluid may comprise at least about 100 SCF (standard cubic feet of gas) for each barrel of well fluid. Preferably, the well fluid will comprise at least about 500 SCF for each barrel of fluid. More preferably, the well fluid will comprise at least about 1000 SCF per barrel of fluid. Most preferably, the well fluid will comprise at least about 5000 SCF per barrel of fluid.

Thus, in accordance with the method of the present invention, downhole operations may be carried out using multi-phase fluids containing extremely high amounts of nitrogen. In addition to accelerating the annular flow, the high nitrogen content in the well fluid makes the tool more active, that is, the nitrogen enhances the oscillatory forces. This enables the operator to advance the drill string even further distances into the wellbore than would otherwise be possible.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms. The description and drawings of the specific embodiments herein do not point out what an infringement of this patent would be, but rather provide an example of how to use and make the invention.

What is claimed is:

1. A method for running a tubular conduit into a borehole of an oil or gas well, the method comprising:

advancing the tubular conduit into the borehole;

pumping a well fluid through the tubular conduit; and generating alternating primary and secondary pulses in the well fluid in the tubular conduit, wherein the primary pulses have an amplitude and the secondary pulses have an amplitude and wherein the amplitude of the primary pulses is greater than the amplitude of the secondary pulses;

wherein the tubular conduit is a drill string that comprises a bottom hole assembly that includes a backpressure tool configured to produce the alternating primary and secondary pulses, wherein the backpressure tool comprises a vortex-controlled variable flow resistance device configured to generate the alternating primary and secondary pulses in the fluid in the drill string, and wherein the primary and secondary pulses generated by the vortex-controlled variable flow resistance device are produced by alternating primary and secondary vortices, the secondary vortex being opposite in direction and weaker in strength relative to the primary vortex.

2. The method of claim 1 wherein the pumping step comprises pumping a multi-phase well fluid through the tubular conduit and wherein the well fluid comprises nitrogen gas in excess of at least about 100 standard cubic feet of gas per barrel.

3. The method of claim 1 wherein the pumping step comprises pumping a multi-phase well fluid through the tubular conduit and wherein the well fluid comprises nitrogen gas in excess of at least about 300 standard cubic feet of gas per barrel.

4. The method of claim 1 wherein the pumping step comprises pumping a multi-phase well fluid through the tubular conduit and wherein the well fluid comprises nitrogen gas in excess of at least about 500 standard cubic feet of gas per barrel.

5. The method of claim 1 wherein the pumping step comprises pumping a multi-phase well fluid through the tubular conduit and wherein the well fluid comprises nitrogen gas in excess of at least about 1000 standard cubic feet of gas per barrel.

6. The method of claim 1 wherein the amplitude of the secondary pulses is less than half the amplitude of the primary pulses.

7. A method for running a tubular conduit into a borehole of an oil or gas well, the method comprising:

advancing the tubular conduit into the borehole;

pumping a well fluid through the tubular conduit; and generating alternating primary and secondary pulses in the well fluid in the tubular conduit, wherein the primary pulses have an amplitude and the secondary pulses have an amplitude, and wherein the amplitude of the primary pulses is greater than the amplitude of the secondary pulses;

wherein the tubular conduit includes a backpressure tool configured to produce the alternating primary and secondary pulses, wherein the backpressure tool comprises a vortex-controlled variable flow resistance device configured to generate the alternating primary and secondary pulses in the fluid in the drill string, and wherein the primary and secondary pulses generated by the vortex-controlled variable flow resistance device are produced by alternating primary and secondary vortices, the secondary vortex being opposite in direction and weaker in strength relative to the primary vortex.

8. The method of claim 7 wherein the pumping step comprises pumping a multi-phase well fluid through the tubular conduit and wherein the well fluid comprises nitrogen gas in excess of at least about 100 standard cubic feet of gas per barrel.

9. The method of claim 7 wherein the pumping step comprises pumping a multi-phase well fluid through the tubular conduit and wherein the well fluid comprises nitrogen gas in excess of at least about 300 standard cubic feet of gas per barrel.

10. The method of claim 7 wherein the pumping step comprises pumping a multi-phase well fluid through the tubular conduit and wherein the well fluid comprises nitrogen gas in excess of at least about 500 standard cubic feet of gas per barrel.

11. The method of claim 7 wherein the pumping step comprises pumping a multi-phase well fluid through the tubular conduit and wherein the well fluid comprises nitrogen gas in excess of at least about 1000 standard cubic feet of gas per barrel.

12. The method of claim 7 wherein the amplitude of the secondary pulses is less than half the amplitude of the primary pulses.

* * * * *